US007874553B2

(12) United States Patent
Kushida et al.

(10) Patent No.: US 7,874,553 B2
(45) Date of Patent: Jan. 25, 2011

(54) SHEET STACKING APPARATUS AND SHEET PROCESSING APPARATUS

(75) Inventors: Hideki Kushida, Moriya (JP); Hitoshi Fujimoto, Abiko (JP); Toshiyuki Iwata, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 153 days.

(21) Appl. No.: 12/390,649

(22) Filed: Feb. 23, 2009

(65) Prior Publication Data

US 2009/0218745 A1 Sep. 3, 2009

(30) Foreign Application Priority Data

Feb. 28, 2008 (JP) ..... 2008-047827
Feb. 13, 2009 (JP) ..... 2009-030794

(51) Int. Cl.
*B65H 37/04* (2006.01)

(52) U.S. Cl. ..... 270/58.27; 270/58.12; 270/58.16; 270/58.17; 271/220

(58) Field of Classification Search ..... 270/58.12, 270/58.16, 58.17, 58.27; 271/220
See application file for complete search history.

(56) References Cited

U.S. PATENT DOCUMENTS 5,205,548 A * 4/1993 Yamada et al. ..... 271/3.2
5,332,210 A * 7/1994 Silverberg et al. ..... 271/220
5,351,112 A 9/1994 Naito et al. ..... 355/233
5,810,551 A * 9/1998 Yamanaka ..... 414/790.7
6,220,592 B1 4/2001 Watanabe et al. ..... 271/241
6,880,823 B2 * 4/2005 Itoh et al. ..... 271/220
6,986,510 B2 * 1/2006 Saito et al. ..... 271/220
7,578,497 B2 * 8/2009 Kawata et al. ..... 270/37
2009/0115129 A1 5/2009 Kushida ..... 271/302

FOREIGN PATENT DOCUMENTS

JP 11-199121 7/1999
JP 2002-154731 5/2002

* cited by examiner

*Primary Examiner*—Patrick Mackey
(74) *Attorney, Agent, or Firm*—Fitzpatrick, Cella, Harper & Scinto

(57) ABSTRACT

The present invention provides a sheet stacking apparatus which has a pair of lower discharge rollers which discharges a sheet, a processing tray which stacks the sheet discharged from the pair of lower discharge rollers, a trailing end stopper which aligns the trailing end portion in the conveying direction of the sheet bundle stacked on the processing tray, and pull-in paddles which drop the sheet discharged from the pair of lower discharge rollers on the processing tray and conveys the sheet to abut against the trailing end stopper where the pull-in paddles rotate at a first rotating speed so that the sheet discharged from the pair of lower discharge rollers is dropped on the processing tray and the pull-in paddles rotate at a second rotating speed, slower than the first rotating speed, so that the sheet abuts against the trailing end stopper.

15 Claims, 20 Drawing Sheets

SHEET STACKING APPARATUS AND SHEET PROCESSING APPARATUS

BACKGROUND OF THE INVENTION

1. Field of the Invention

The present invention relates to a sheet stacking apparatus which aligns and stacks sheets and a sheet processing apparatus having the same.

2. Description of Related Art

In conventional sheet processing apparatuses, an apparatus which processes the sheet stacked on an intermediate processing tray after performing the alignment in the conveying direction by a plurality of return paddles and a trailing end stopper and the alignment in the width direction perpendicular to the sheet conveying direction by a lateral aligning member has been proposed (refer to Japanese Patent Application Laid-Open No. 11-199121).

Further, there is an apparatus which can reliably allow the sheet to be drawn to the stopper by changing an operating time of pulling of the return paddle which performs the alignment in the conveying direction between a sheet in a different alignment process and a sheet other than the final sheet, and thus avoids the misalignment of the sheet (refer to JP-A No. 2002-154731).

Furthermore, there is an apparatus which keeps the contact area between the topmost sheet and the return paddle always constant in order to prevent the sheet from being excessively returned due to changes of the contact area of the return paddle (refer to U.S. Pat. No. 6,220,592). Conventionally, the trailing end of the sheet is abutted toward the trailing end stopper by rotating such a return paddle during a sheet discharge interval. However, the sheet discharge interval varies depending on the size of the sheet. Thus, it is necessary to control each sheet so that it is discharged within each of the discharge intervals. For example, a small size sheet (e.g. A4, LTR, etc.) whose discharge interval is short is rotated one rotation while a large size sheet (e.g. A3, LDR, LGL, etc.) whose discharge interval is long is rotated two rotations.

Further, a sheet with a large mass like a large size sheet (namely, a sheet having a large inertial force) is required to be returned by a large conveying force. Therefore, the rotating speed of the return paddle is changed according to the size of the sheet. When the mass of the sheet is large, the conveying force of the sheet is increased by increasing the rotation number of the paddle. The denting, folding, and bounce of the trailing end of the sheet when the sheet is abutted against the trailing end stopper is suppressed by rotating the return paddle at a uniform speed. The rotating speed of the return paddle at this time is set to 700 mm/s to 800 mm/s.

In some cases, the conventional sheet processing apparatuses align a thin paper (grammage; approximately 40 to 52 g/m$^2$) whose grammage is lower than that of a plain paper for printing (grammage; approximately 64 to 80 g/m$^2$). In the case where a thin paper whose sheet stiffness is small is abutted against the trailing end stopper at the rotating speed of the return paddle (700 to 800 mm/s) similar to that of the plain paper and aligned, the paper may be buckled when it is abutted against the trailing end stopper. As a result, alignment properties of the thin paper may be reduced. As with the case of the thin paper, when the plain paper for printing is abutted against the trailing end stopper, the plain paper may be buckled depending on the use environment.

For example, the stiffness of the plain paper is decreased by moisture absorption effect of the sheet when used under a high-humidity condition. The stiffness is the same as that of the thin paper and thus the plain paper may be buckled. When used under a low-humidity condition, the end portion of the sheet has a curled-up shape (hereinafter referred to as curl). When the sheet is curled in the front-back direction in the sheet conveying direction, the elasticity of the end to be abutted against the trailing end stopper becomes poor and thus the sheet is easily buckled.

Even if the small size sheet can be abutted against the trailing end stopper by giving the return paddle one rotation, when the large size sheet is used, the sheet may not be returned to the trailing end stopper unless the paddle is rotated two rotations. This is because the inertial force is large. Therefore, the rotating speed of the return paddle is uniformly increased in order to give the paddle two rotations during the sheet discharge interval. However, since the return paddle is rotated twice during the short discharge interval of the sheet, the denting, folding, and bounce of the trailing end of the sheet can be caused when the return paddle is speeded up to rotate twice.

As described above, when conventional sheet stacking apparatuses are connected to an output apparatus such as an image forming apparatus having a high productivity, a sheet discharge interval which can be processed is limited and further a high-speed aligning operation is difficult. There has been a difficulty in handling a wide variety of sheets such as thin paper. With reference to the use environment, the use under a wide range of environments has been difficult.

The present invention provides a sheet stacking apparatus and a sheet processing apparatus which can improve aligning properties, stacking properties, and discharge productivity regardless of the sheet type, the sheet size, and the use environment.

SUMMARY OF THE INVENTION

In order to solve such problems, typical structures of the sheet stacking apparatus and the sheet processing apparatus according to the present invention include a sheet discharging portion which discharges a sheet; a stacking portion which stacks the sheet discharged from the sheet discharging portion; a regulating portion which aligns an end portion in a discharge direction of a sheet bundle stacked on the stacking portion; and a rotating member which drops the sheet discharged from the sheet discharging portion on the stacking portion by applying a force to the discharged sheet from above and conveys the sheet in a direction opposite to the discharge direction of the sheet discharging portion to abut against the regulating portion; wherein the rotating member rotates at a first rotating speed so that the sheet discharged from the sheet discharging portion is dropped on the stacking portion and the rotating member rotates at a second rotating speed, slower than the first rotating speed, so that the sheet abuts against the regulating portion.

According to the present invention, aligning properties, stacking properties, and discharge productivity can be improved regardless of the sheet type, the sheet size, and the use environment.

Further features of the present invention will become apparent from the following description of exemplary embodiments (with reference to the attached drawings).

DESCRIPTION OF THE EMBODIMENTS

A sheet discharging apparatus, a sheet processing apparatus, and an image forming apparatus according to the embodiments will be described.

(Image Forming Apparatus)

Figure 1:
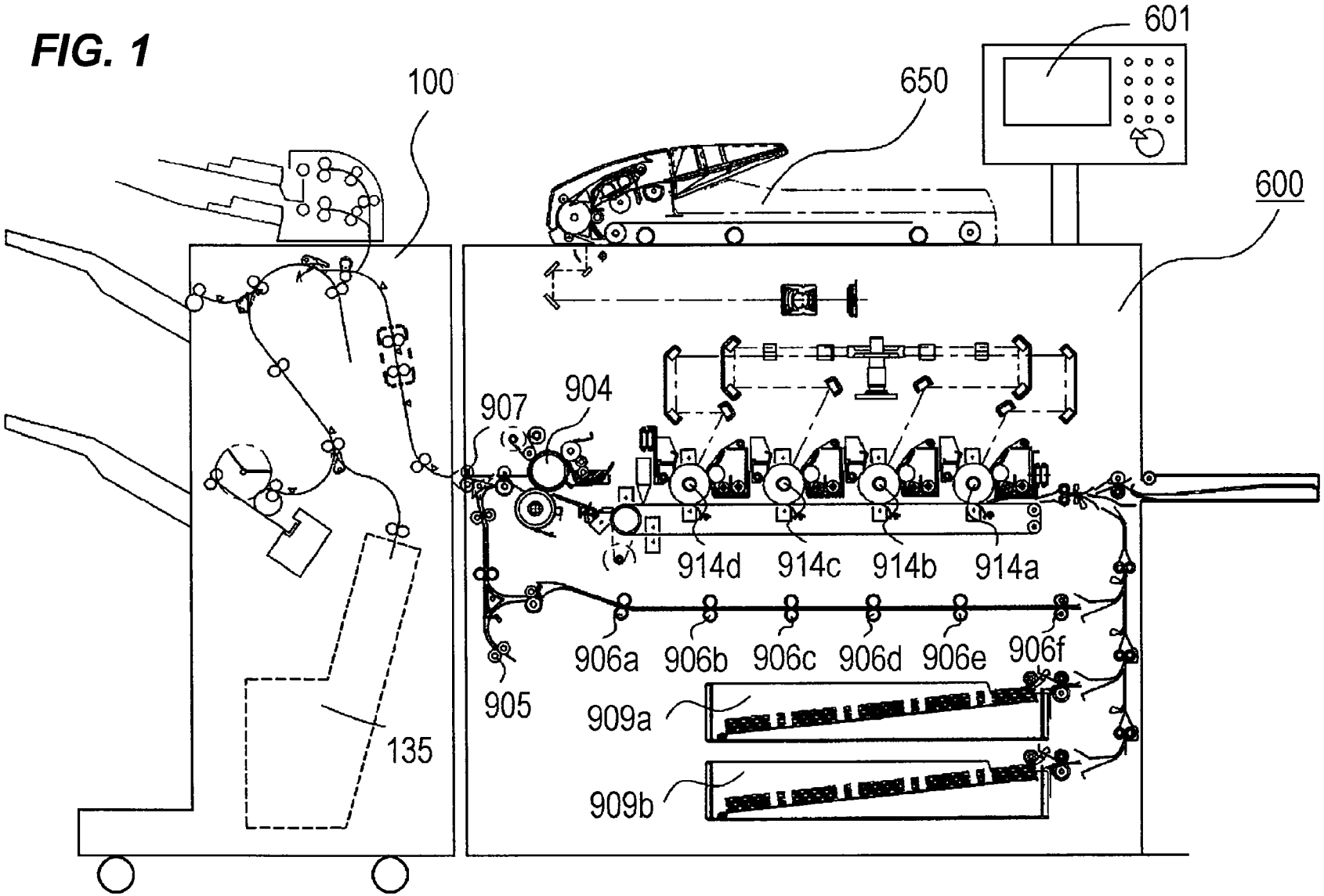
FIG. 1 is a structural diagram of an image forming apparatus and a sheet processing apparatus according to an embodiment.

FIG. 1 is a structural diagram of the image forming apparatus and the sheet processing apparatus. As illustrated in FIG. 1, the image forming apparatus has an image forming apparatus body 600 which forms monochrome and color images and an intermediate binding apparatus (finisher) 100 connected thereto. Therefore, the sheet discharged from the image forming apparatus body 600 can be processed by the finisher 100 which is online. The image forming apparatus body 600 can be used alone without connecting to a discharging outlet of the finisher 100. Further, the finisher 100 as the sheet discharging apparatus may be integrally embedded in the image forming apparatus body 600. Here, a position facing an operation portion 601 is called as a front side of the front of the image forming apparatus (hereinafter referred to as the front side) and the back side of the apparatus is called as a rear side since a user inputs various data to the image forming apparatus body 600 and configures the settings therefor. FIG. 1 illustrates a structure of the image forming apparatus seen from the front side of the apparatus. The finisher 100 is connected to the side portion of the image forming apparatus body 600.

Toner images of four colors are transferred to a sheet S supplied from cassettes 909*a* and 909*b* in the image forming apparatus body 600 by photoconductive drums 914*a* to 914*d* of yellow, magenta, cyan, and black which include image forming portions. Then, the sheet S is conveyed to a fixing device 904 and a toner image is fixed. When a single-sided image forming mode is selected, the sheet S is directly discharged from a pair of discharge rollers 907 to the outside of the apparatus body. When a duplex image forming mode is selected, the sheet S is delivered from the fixing device 904 to a reversal roller 905. When the trailing end in the sheet conveying direction is passed through a reverse flapper portion P, the reversal roller 905 is reversely rotated and the sheet S is conveyed in the direction of duplex conveying rollers 906*a* to 906*f* which is opposite to the conveying direction. Then, toner images of four colors are again transferred to the back side of the sheet S by the photoconductive drums 914*a* to 914*d* of yellow, magenta, cyan, and black. The sheet S in which toner images are transferred to duplex sides is again conveyed to the fixing device 904. Then, the toner images are fixed and the sheet S is discharged from the pair of discharge rollers 907 to the outside of the apparatus body.

(Sheet Processing Apparatus)

Figure 2:
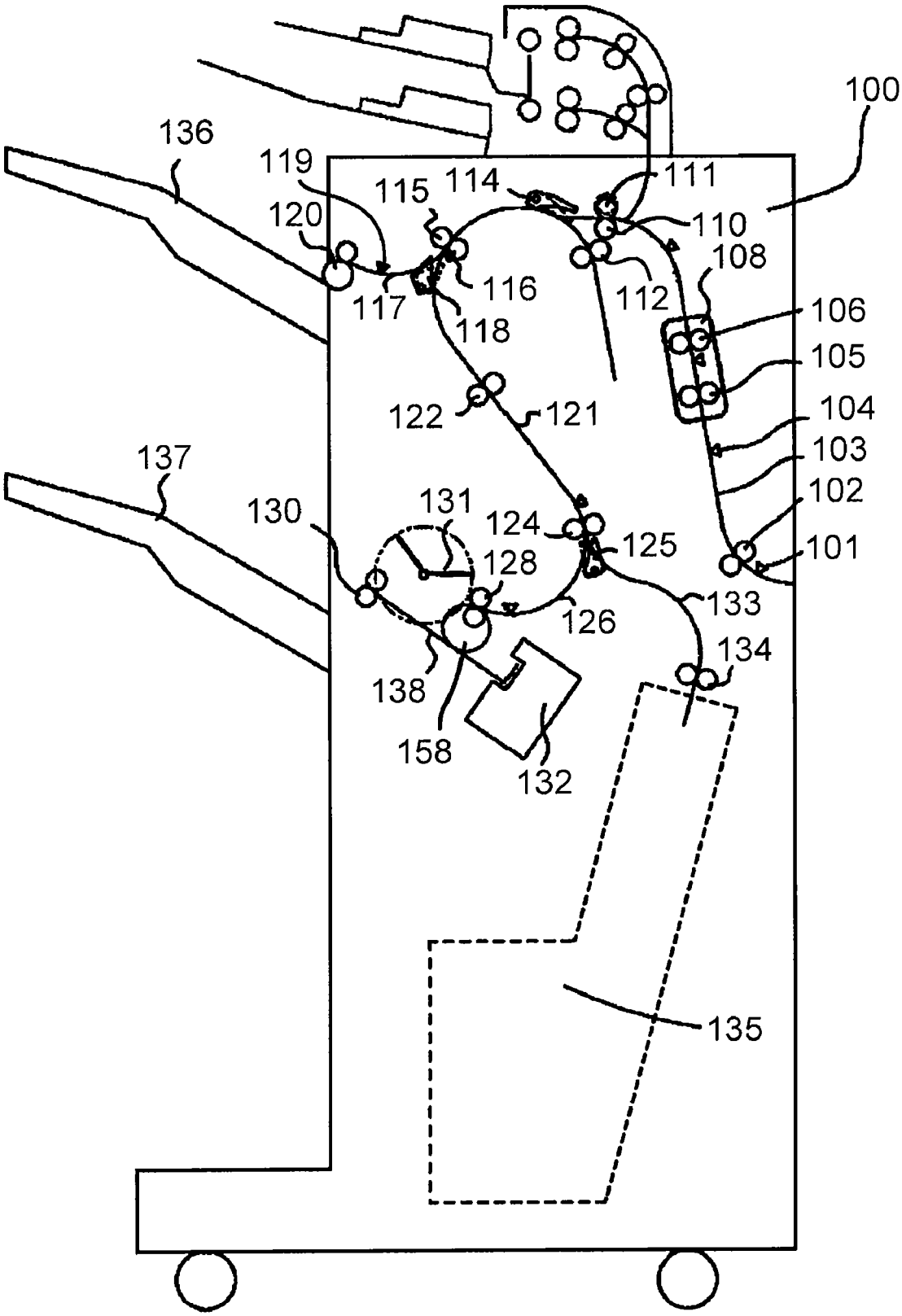
FIG. 2 is a structural diagram of the sheet processing apparatus according to the embodiment.

FIG. 2 is a structural diagram of an intermediate binding apparatus (finisher) 100 as the sheet processing apparatus. As illustrated in FIG. 2, the finisher 100 has the sheet stacking apparatus and a stapler 132 as a sheet processing unit. The sheet stacking apparatus has a pair of lower discharge rollers 128 as the sheet discharging portion, a pull-in paddle 131 as the rotating member, and an intermediate processing tray 138 as the stacking portion.

The sheet S discharged from the image forming apparatus body 600 is delivered to a pair of inlet rollers 102 of the finisher 100. At this time, the sheet delivery timing is simultaneously detected by an inlet sensor 101. While the sheet S conveyed by the pair of inlet rollers 102 passes a conveying path 103, the end position in the width direction perpendicular to the sheet conveying direction is detected by an end portion detecting sensor 104. Thus, the error level relative to a conveying center position in the width direction of the sheet processing apparatus is detected.

While the sheet S is conveyed to a pair of shift rollers 105 and 106 after detecting the error in the width direction, a shift unit 108 moves a predetermined distance in front or rear directions, thereby performing the shift operation of the sheet.

Thereafter, the sheet S conveyed by a conveying roller 110 and a spacing roller 111 is conveyed by a pair of buffer rollers 115. When the sheet S is then discharged to an upper discharge tray 136, an upper path switching member 118 is in a state illustrated by a dashed line in FIG. 2 by a driving portion (not illustrated) such as solenoid. Then, the sheet S is guided to an upper path conveying path 117 and discharged from a pair of upper discharge rollers 120 to the upper discharge tray 136.

When the sheet S is not discharged to the upper discharge tray 136, the sheet S conveyed by the pair of buffer rollers 115 is guided to a bundle conveying path 121 by the upper path switching member 118. Then, the sheet S is sequentially passed through the inside of the conveying path by the pair of buffer rollers 122 and a pair of bundle conveying rollers 124. When the sheet is saddle-processed (intermediate binding), a saddle path switching member 125 is in a state illustrated by a dashed line by a driving portion (not illustrated) such as solenoid. Then, the sheet is conveyed to a saddle path 133, guided to a saddle unit 135 by a pair of saddle inlet rollers 134, and saddle-processed (intermediate binding process).

When the conveyed sheet S is discharged to a lower discharge tray 137 as a first stack tray, the sheet S conveyed to the pair of bundle conveying rollers 124 is conveyed to a lower path 126 by a saddle switching member 125. Thereafter, the sheet S discharged to a intermediate processing tray 138 as a second stack tray by the pair of lower discharge rollers 128 is processed in the intermediate processing tray 138. Thereafter, the sheet S is discharged to the lower discharge tray 137 by a pair of discharge rollers 130 as a bundle discharging portion.

(Description of Intermediate Processing Tray Portion)

Subsequently, the intermediate processing tray portion will be described with reference to FIGS. 3 to 7.

Figure 3:
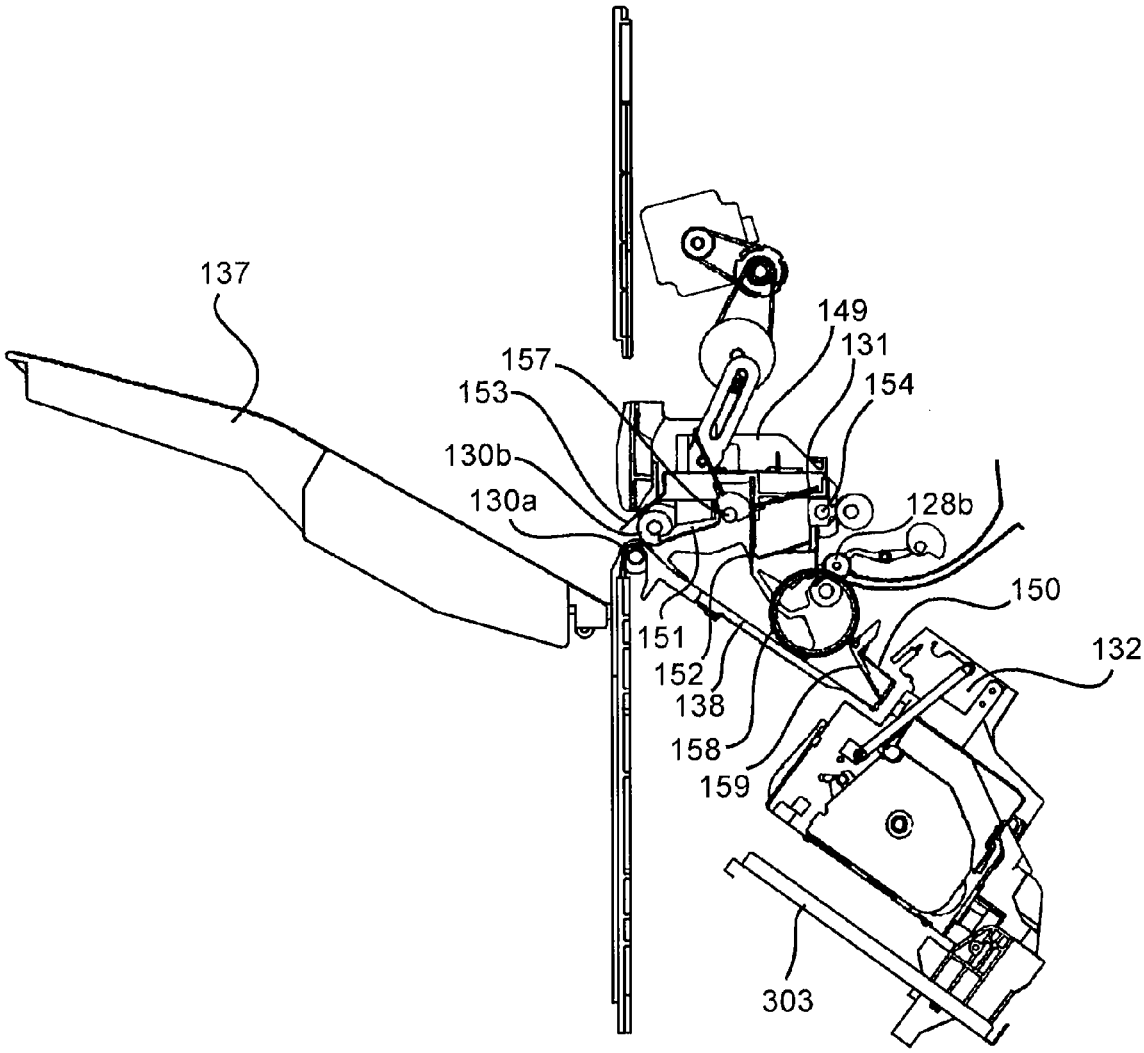
FIG. 3 is a structural diagram describing an intermediate processing tray portion according to the embodiment.

As illustrated in FIG. 3, the processing tray 138 as the second stack tray is disposed so that the downstream side (left side of FIG. 3) is upwardly inclined and the upstream side (right side of FIG. 3) is downwardly inclined to the conveying direction of a sheet bundle. A trailing end stopper (regulating portion) 150 is disposed at a lower end portion which is the upstream side of the processing tray 138.

A lower discharge roller 130*a* of the pair of discharge rollers 130 is disposed at an upper end portion which is the downstream side of the processing tray 138. An upper discharge roller 130*b* of the pair of discharge rollers 130 is disposed at a front end portion of the under surface of a swing guide 149. The upper discharge roller 130*b* is separately in contact with the lower discharge roller 130*a* as the opening and closing operation of the swing guide 149. When a rotative driving force is applied to each of upper and lower discharge roller shaft portions from a drive motor M130 which is a driving portion, the pair of discharge rollers 130 is rotates forward and reversely. Therefore, the pair of discharge rollers 130 can discharge and convey the sheet in a discharge direction for discharging the sheet to the lower discharge tray 137 and a conveying direction for conveying the sheet to the processing tray 138.

In the swing guide 149, a guiding guide 151, a first charge removal needle 152, and a second charge removal needle 153 are respectively disposed in an axial direction. The swing guide 149 is rotatably supported by a support shaft 154 and is movable in a vertical direction.

Figure 4:
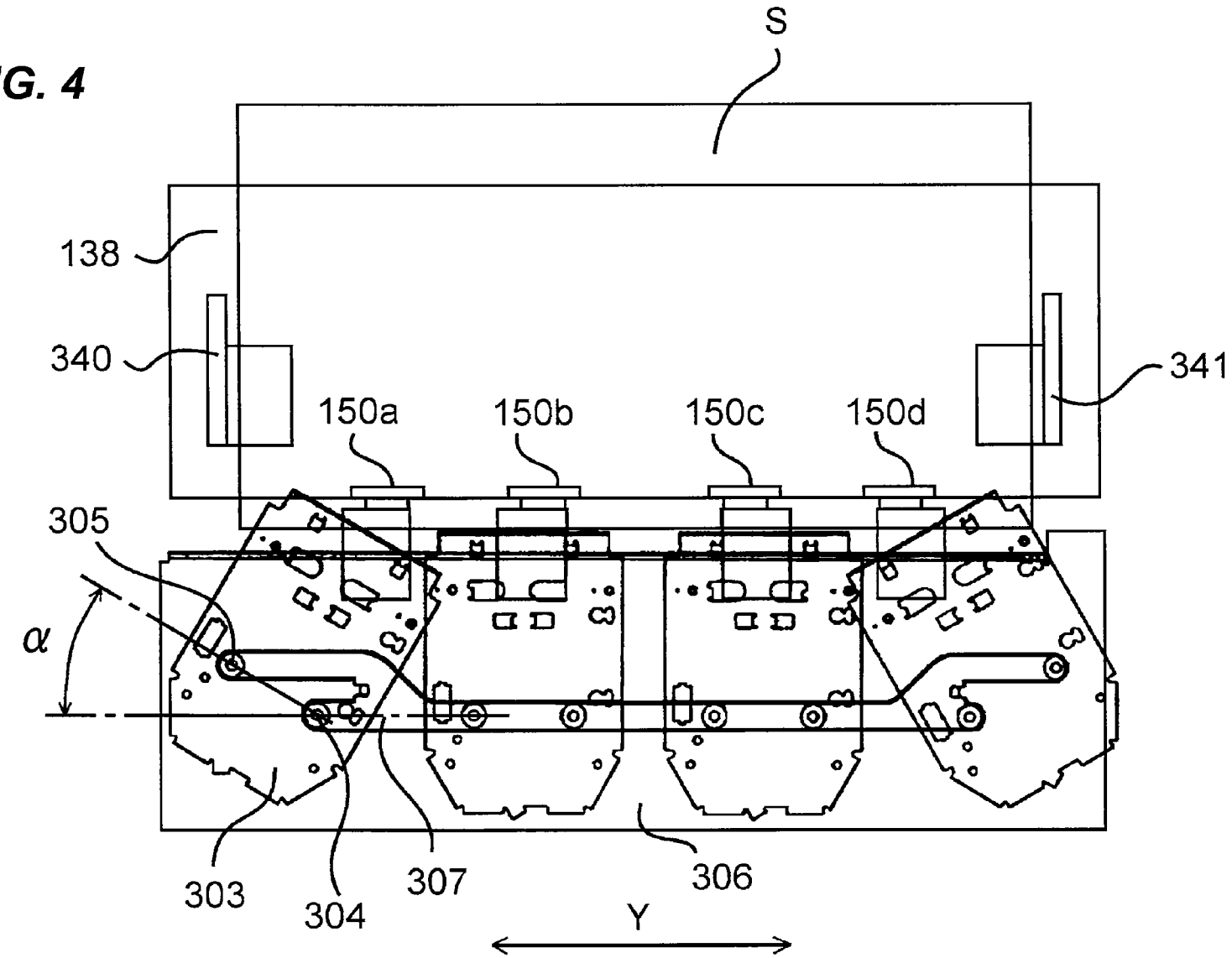
FIG. 4 is a top perspective view describing the intermediate processing tray portion according to the embodiment.

The stapler 132 is fixed on a slide supporter 303. As illustrated in FIG. 4, roller bearings 304 and 305 are provided in the lower part of the slide supporter 303. The slide supporter 303 is guided by the roller bearings 304 and 305 and a guide rail groove 307 on a stapler moving table 306 and is moved along a trailing end edge of the sheet S stacked by the processing tray 138 (in the direction of an arrow Y).

The stapler 132 is maintained so that it is inclined at a predetermined angle $\alpha$ to the trailing end edge of the sheet in the corner of the sheet S stacked on the processing tray 138. The inclined angle $\alpha$ is set to about 30 degree and it can be changed by changing the shape of the guide rail groove 307. A position sensor (not illustrated) which detects the home position of the stapler 132 is provided in the stapler moving table 306. Usually, the stapler 132 is standby at the home position at the front side of the apparatus.

Figure 5:
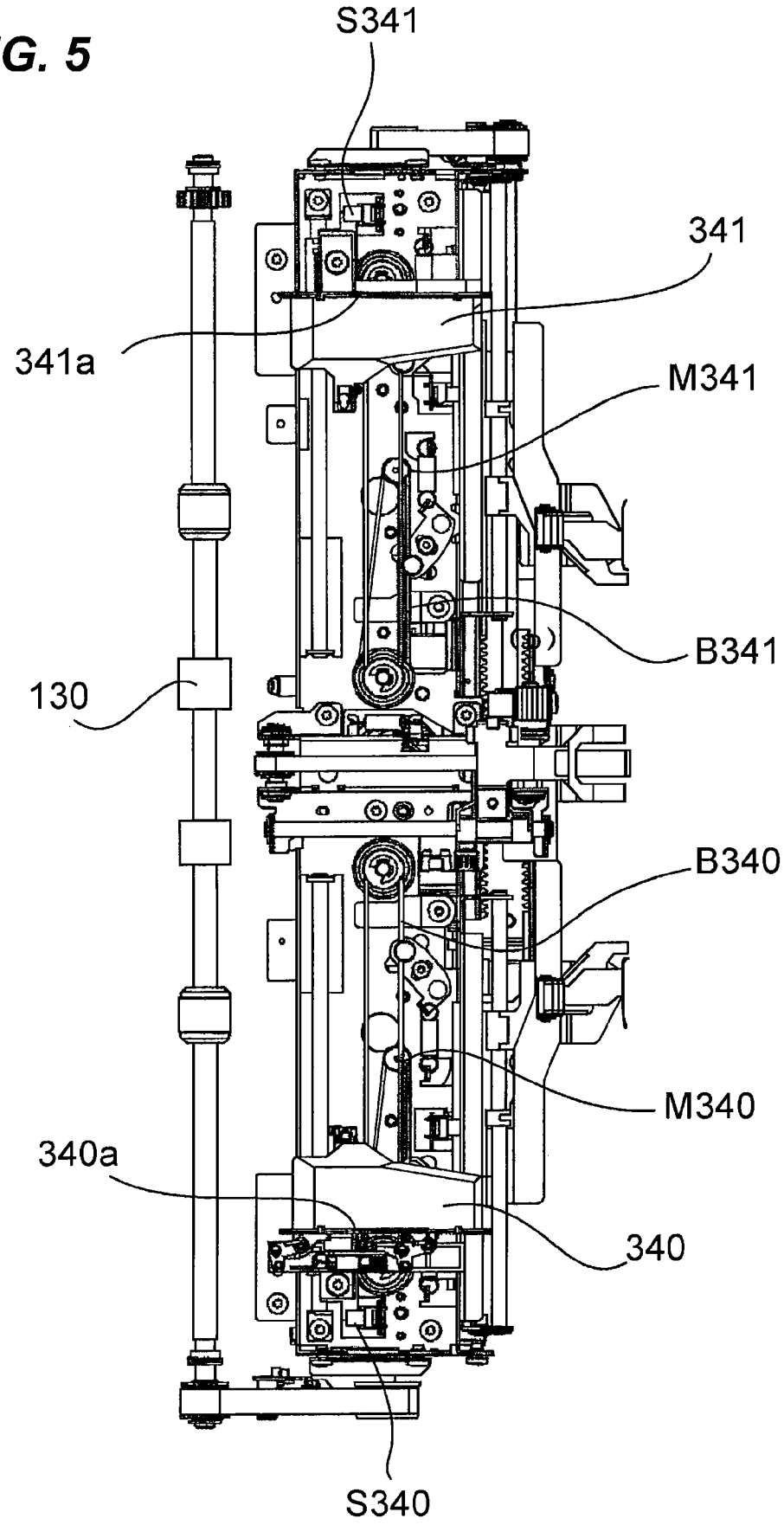
FIG. 5 is an explanatory diagram of an aligning member according to the embodiment.

As illustrated in FIG. 5, a front side aligning member 340 (a first aligning member) and a rear side aligning member 341 (a second aligning member) which form aligning members align the right and left end sides in the width direction perpendicular to the conveying direction of the sheet stacked in the processing tray 138.

The first and second aligning members 340 and 341 are disposed on the surface of the processing tray 138 so as to be individually opposed to both ends of the sheet S. The first and second aligning members 340 and 341 have aligning surfaces 340*a* and 341*a* which are perpendicular to the processing tray 138. The aligning surfaces 340*a* and 341*a* press and support the sheet side edge surface.

The aligning members have first and second drive motors M340 and M341 which can individually drive a pair of the aligning members 340 and 341 at right and left sides. A driving force is transmitted from a top pulley of the drive motors M340 and M341 to the first and second aligning members 340 and 341 via timing belts B340 and B341. Here, the drive motors M340 and M341, the top pulley, and the timing belts B340 and B341 include driving portions. As a result, the first and second aligning members 340 and 341 are individually movable along the width direction of the sheet to the processing tray 138. In other words, each of the aligning surfaces 340*a* and 341*a* are disposed on the processing tray 138 so as to be opposed to each other. Further, each driving portion is attached to the under surface side so as to be forwardly and reversely movable in the width direction.

Here, sensors S340 and S341 which detect each home position are disposed at the first and second aligning members 340 and 341. When the first and second aligning members 340 and 341 are not operated, they are standby at each home position (both ends).

Figure 6:
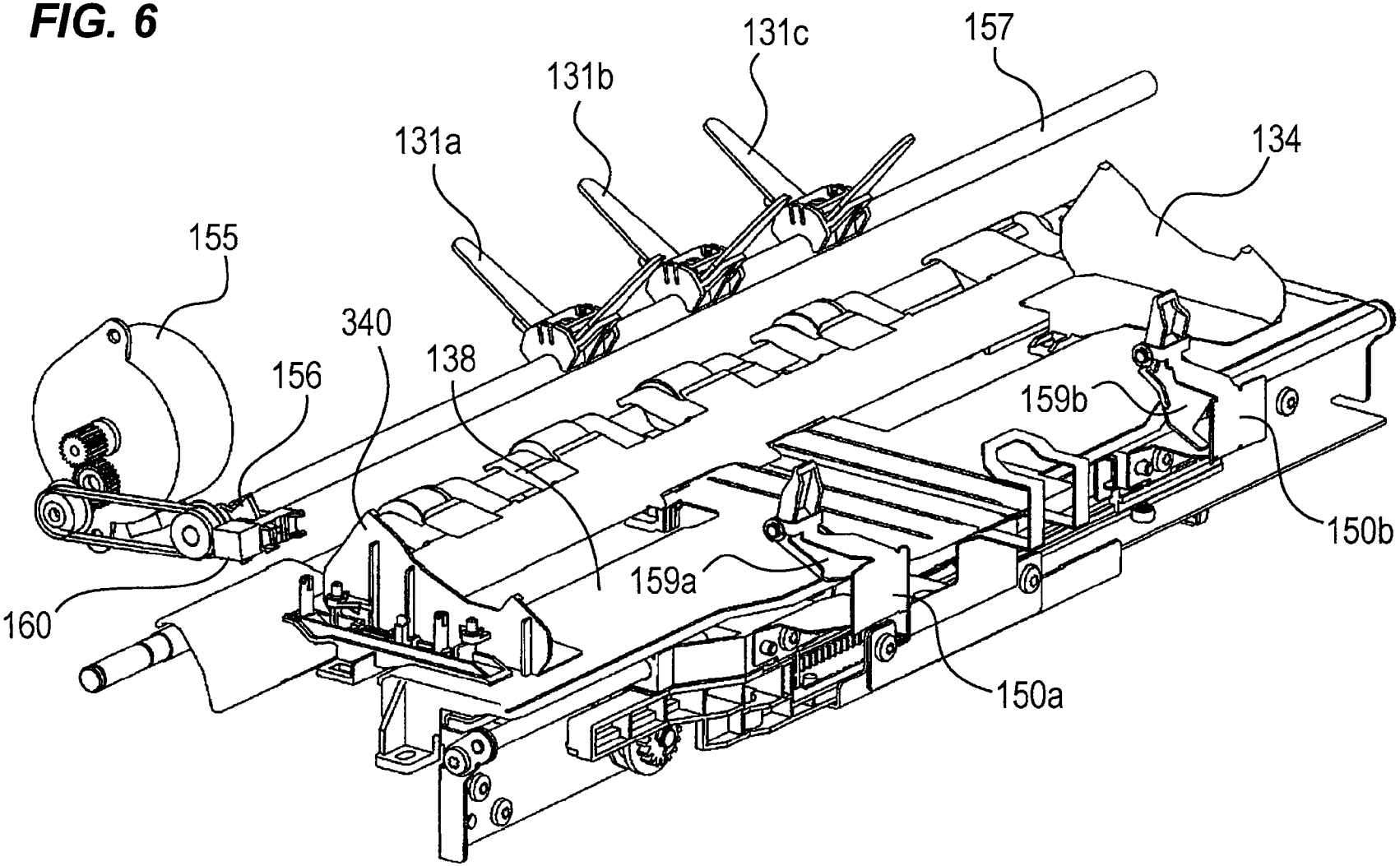
FIG. 6 is a structural diagram of a rotating member according to the embodiment.
Figure 7:
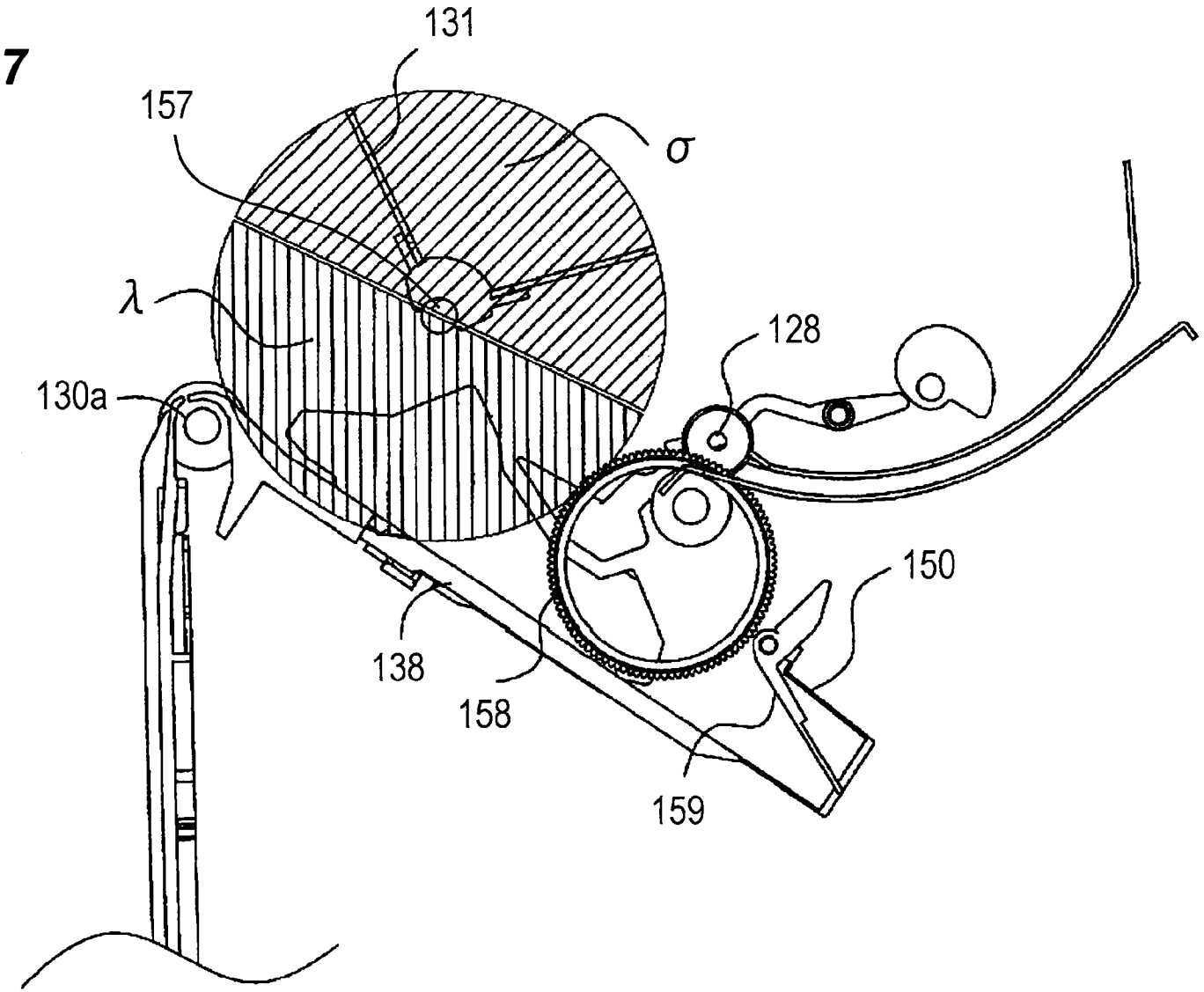
FIG. 7 is an explanatory diagram of an operation of the rotating member according to the embodiment.

As illustrated in FIG. 6, the pull-in paddles 131 (131*a*, 131*b*, and 131*c*) are disposed at the upper part of the processing tray 138. A plurality of the pull-in paddles 131 are fixed on the drive shaft 157 which are driven and connected by a gear train from a paddle rotation motor 155. The pull-in paddles 131 are rotating members which are rotated in a counterclockwise direction (in FIG. 6) at a proper timing by the paddle rotation motor 155. Further, the pull-in paddles 131 are fixed on the drive shaft 157 so that two blades (conveying members) maintain a predetermined angle. As illustrated in FIG. 7, two blades are provided at the pull-in paddles 131 so as to come into contact with the surface of the sheet from above intermittently. The pull-in paddles 131 have a conveying rotational region (conveying region) $\lambda$ which comes into contact with the surface of the sheet and a non-conveying rotational region (non-conveying region) $\sigma$ which does not come into contact with the surface of the sheet. The conveying region and the non-conveying region are provided so that a phase angle is shifted by about a half rotation with respect to the drive shaft 157. Usually, when the tip end portion of the sheet is discharged from the pair of lower discharge rollers 128 to the processing tray 138, the two blades stop at a position, in the non-conveying region, which does not obstruct the discharge of the sheet. The position is set as a home position at the time of startup of the apparatus or at the time of startup of printing job. Therefore, in order to detect the rotational position of the drive shaft 157, a paddle rotation detecting sensor 160 which detects the rotational position of the pull-in paddles 131 is provided. The paddle rotation detecting sensor 160 detects a detection flag 156 provided on the drive shaft 157 and the end portion of the detection flag 156 so that the paddle rotation detecting sensor 160 detects the rotational position of the pull-in paddles 131.

In this regard, a plurality of the pull-in paddles 131 are provided along an axial direction of the drive shaft 157. Since the plurality of the pull-in paddles 131 are thus provided, the plurality of the pull-in paddles 131 uniformly come into contact with the surface of the sheet when the sheet is pulled into trailing end stoppers 150*a* and 150*b* by the pull-in paddles 131. Therefore, the turning of the sheet caused by ununiform contact does not occur. Thus, the sheet can be abutted against the trailing end stoppers 150*a* and 150*b* so as not to be skew-conveyed.

Subsequently, a sheet trailing end aligning portion will be described. A belt roller 158 as a sheet conveying portion and a trailing end lever 159 as a sheet pressing member are disposed at the upstream side of the processing tray 138.

While the sheet is guided to the trailing end lever 159 by rotation in a direction in which the sheet is moved in a direction opposite to the discharge direction of the pair of lower discharge rollers 128 of the belt roller 158, the sheet is abutted against a trailing end stopper 150 and then aligned.

In other words, the belt roller 158 is provided on the outer circumference of a discharge roller 128*a* which includes the pair of lower discharge rollers 128 as a sheet discharging portion. The belt roller 158 rotates following the rotation of the discharge roller 128*a*. The belt roller 158 is provided at the upper part of the processing tray 138 so as to keep a positional relation in which the lower part of the belt roller 158 comes into contact with the top most sheet stacked on the processing tray 138.

<Description of Discharging Portion in Non-Staple Sort Mode>

Subsequently, the flow of sheets in the non-staple sort mode will be described with reference to FIGS. 8 and 9.

Figure 8:
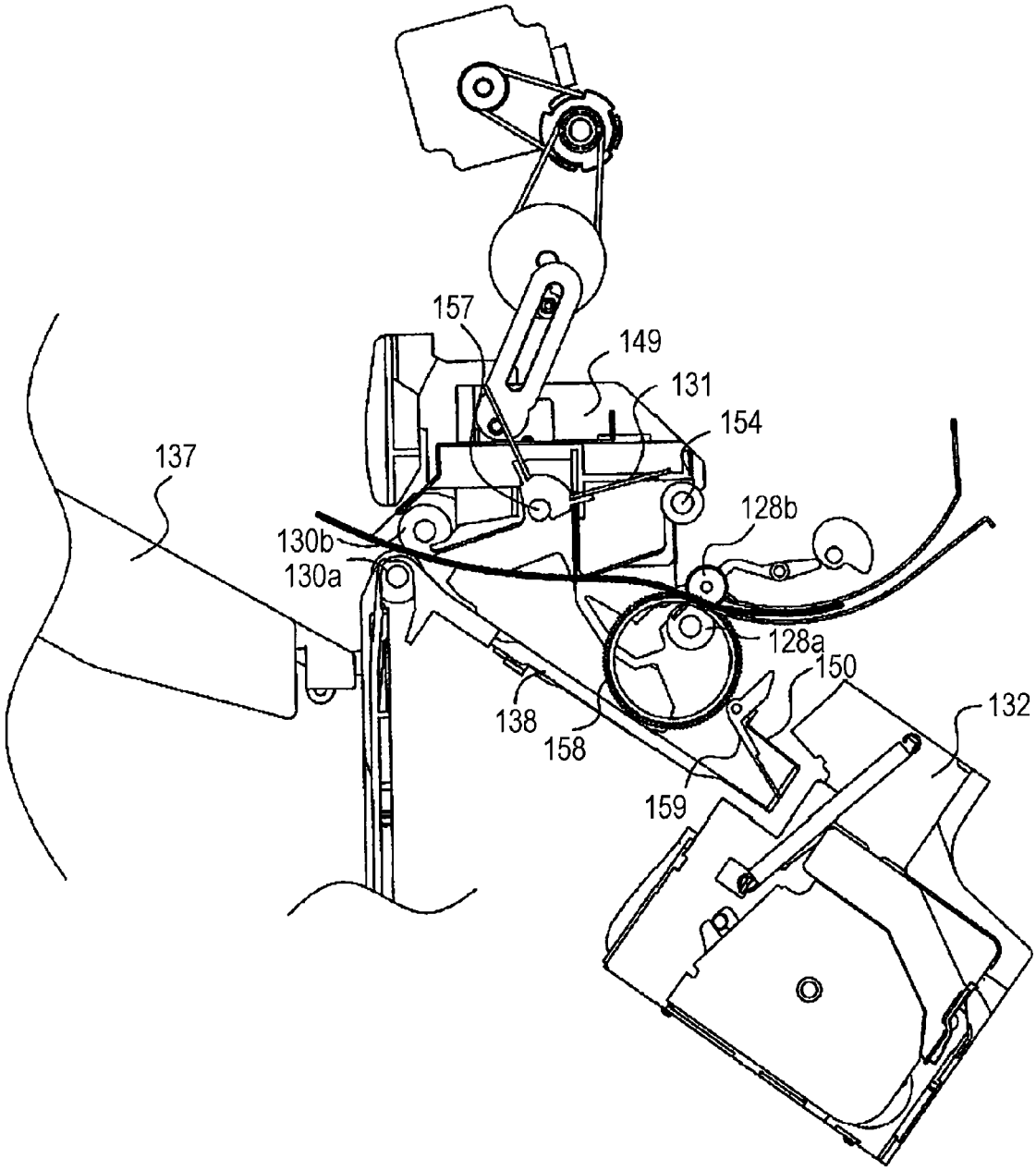
FIG. 8 is a diagram describing a flow of sheets and an operation of the intermediate processing tray in a non-staple sort mode.
Figure 9:
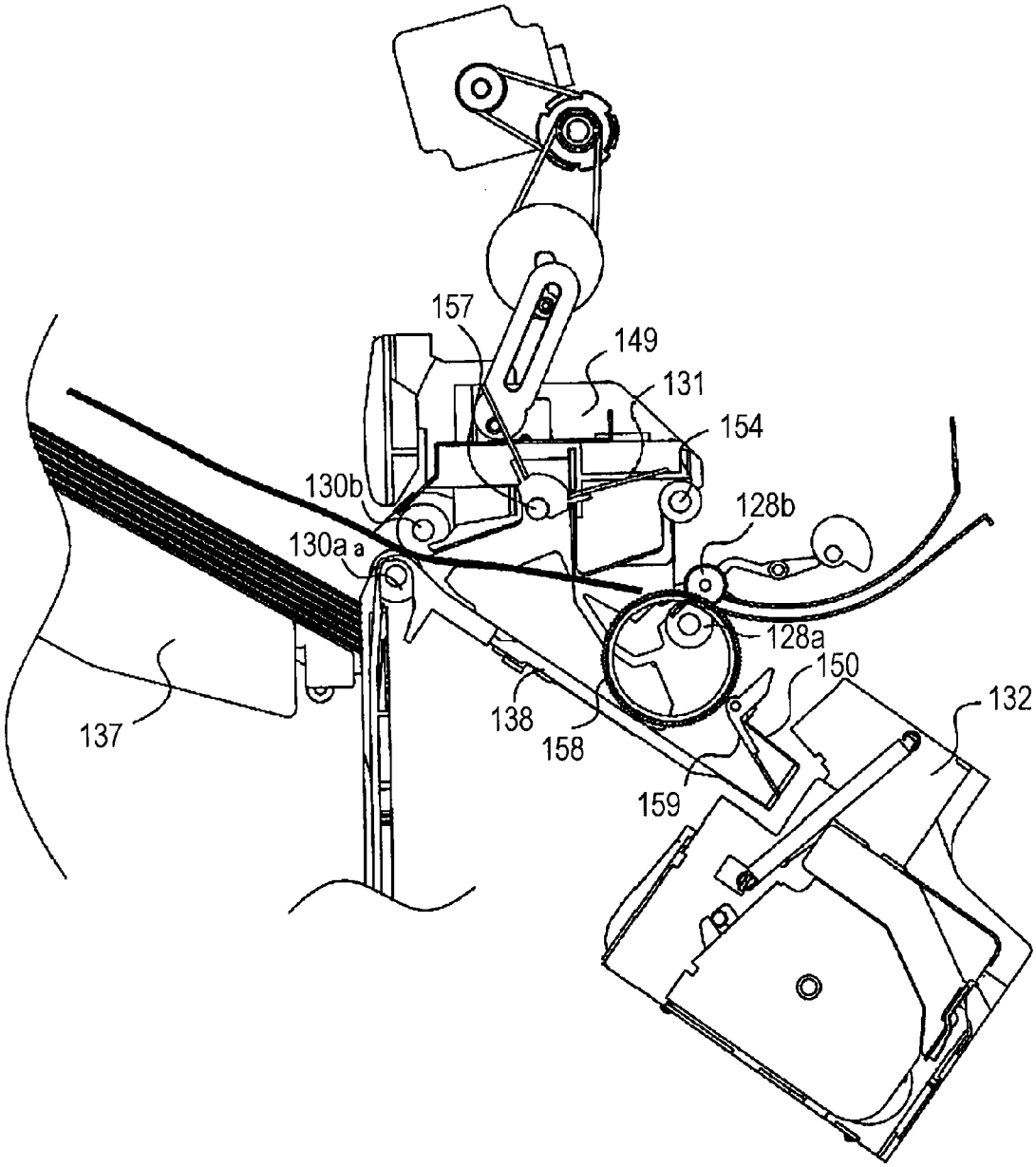
FIG. 9 is a diagram describing the flow of sheets and the operation of the intermediate processing tray in the non-staple sort mode.

As illustrated in FIGS. 8 and 9, when a non-staple sort mode job is selected, the sheet discharged from the image forming apparatus is conveyed while the sheet is shifted in the direction perpendicular to the conveying direction (front side in FIG. 2) at a predetermined distance by the shift unit 108. The sheet is discharged to the lower discharge tray 137 from the pair of lower discharge rollers 128 through the pair of discharge rollers 130. The same operation for the set sorting number of sheets is repeated. While a second bundle is shifted to the side opposite (back side in FIG. 2) to the shift direction of a first bundle at a predetermined distance, the second bundle is discharged to the lower discharge tray 137 from the pair of lower discharge rollers 128 through the pair of discharge rollers 130 in the same manner as that of the first bundle.

For example, in the embodiment, a shift distance is set to 15 mm from the discharge center to one side. As a result, a bundle of sheets is stacked on the lower discharge tray 137 in the state that the bundle of sheets is shifted by 30 mm as a sorting offset quantity between the bundle of sheets.

When a non-sort mode is selected, misalignment correction in the width direction which returns the sheet to an original center position in the width direction perpendicular to the conveying direction is performed by the shift unit 108 for the sheet shifted (due to skew feeding) in the upstream portion. Then, when the sheet reaches the center position in the width direction, the sheet is discharged to the lower discharge tray 137 as the first stack tray through the pair of discharge rollers 130.

<Description of Operation of Discharging Portion in Staple Sort Mode>

The flow of sheets in the staple sort mode will be described with reference to FIGS. 10 to 14.

When the staple sort mode job is selected, a sheet S11 which is the first page of the first bundle discharged from the image forming apparatus body 600 is conveyed while it is shifted toward the front side in FIG. 2 at a predetermined distance by the shift unit 108. Then, the sheet is conveyed to the upper discharge roller 130*b* and the lower discharge roller 130*a* by the pair of lower discharge rollers 128.

Figure 10:
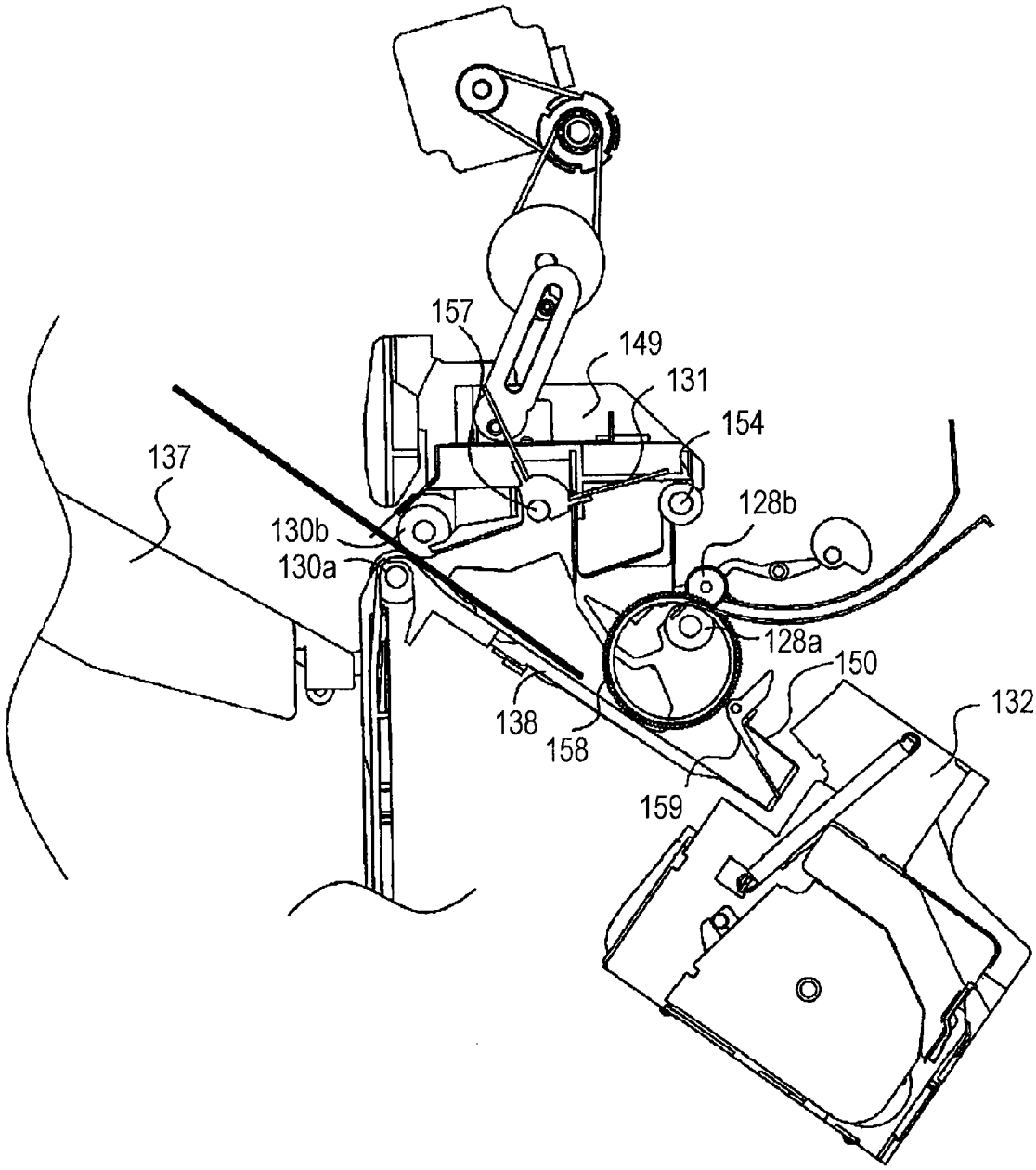
FIG. 10 is a diagram describing a flow of sheets and an operation of the intermediate processing tray in a staple sort mode.

As illustrated in FIG. 10, the trailing end of the sheet S11 in the conveying direction is passed through the pair of lower discharge rollers 128 and then a predetermined amount of the sheet is conveyed by the pair of discharge rollers 130. Thereafter, the sheet S11 is conveyed in a direction opposite to the discharge direction of the pair of discharge rollers 130 at a conveying speed Vb so that the trailing end of the sheet S11 is abutted against the trailing end stopper 150 by rotating the pair of discharge rollers 130 in the opposite direction.

Figure 11:
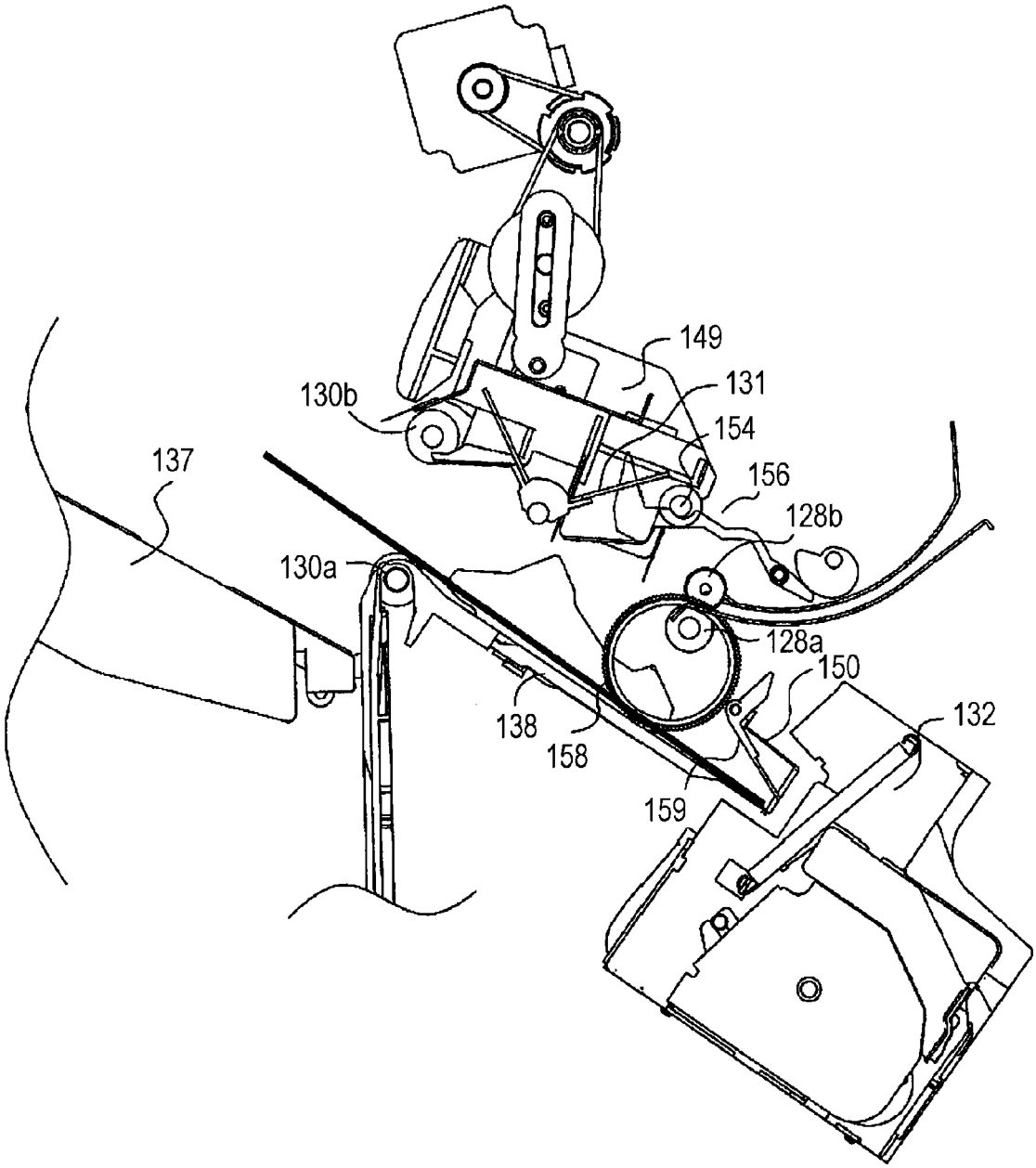
FIG. 11 is a diagram describing the flow of sheets and the operation of the intermediate processing tray in the staple sort mode.

As illustrated in FIG. 11, the swing guide 149 is raised before the trailing end of the sheet S11 is abutted against the trailing end stopper 150 and the upper discharge roller 130*b* is spaced from the lower discharge roller 130*a*. As a result, the conveyed sheet S11 can be aligned by abutting it against the trailing end stopper 150 in a running state by an inertial force of the conveying speed Vb. Particularly, the buckling which is easily generated in the case of a thin sheet can be prevented.

When the alignment of the end portion (trailing end) in the conveying direction of the sheet S11 is completed, the alignment in the width direction perpendicular to the conveying direction is then carried out by the pair of aligning members 340 and 341.

Subsequently, a sheet S12 which is the second page of the first bundle is discharged from the pair of lower discharge rollers 128 to the processing tray 138. At this time, the swing guide 149 is located at the rising position and receives the sheet S12 in a state that the upper discharge roller 130*b* is spaced from the lower discharge roller 130*a*. When the trailing end in the conveying direction of the sheet S12 is passed through a nip of the pair of lower discharge rollers 128, the sheet is discharged to the processing tray 138.

Figure 12:
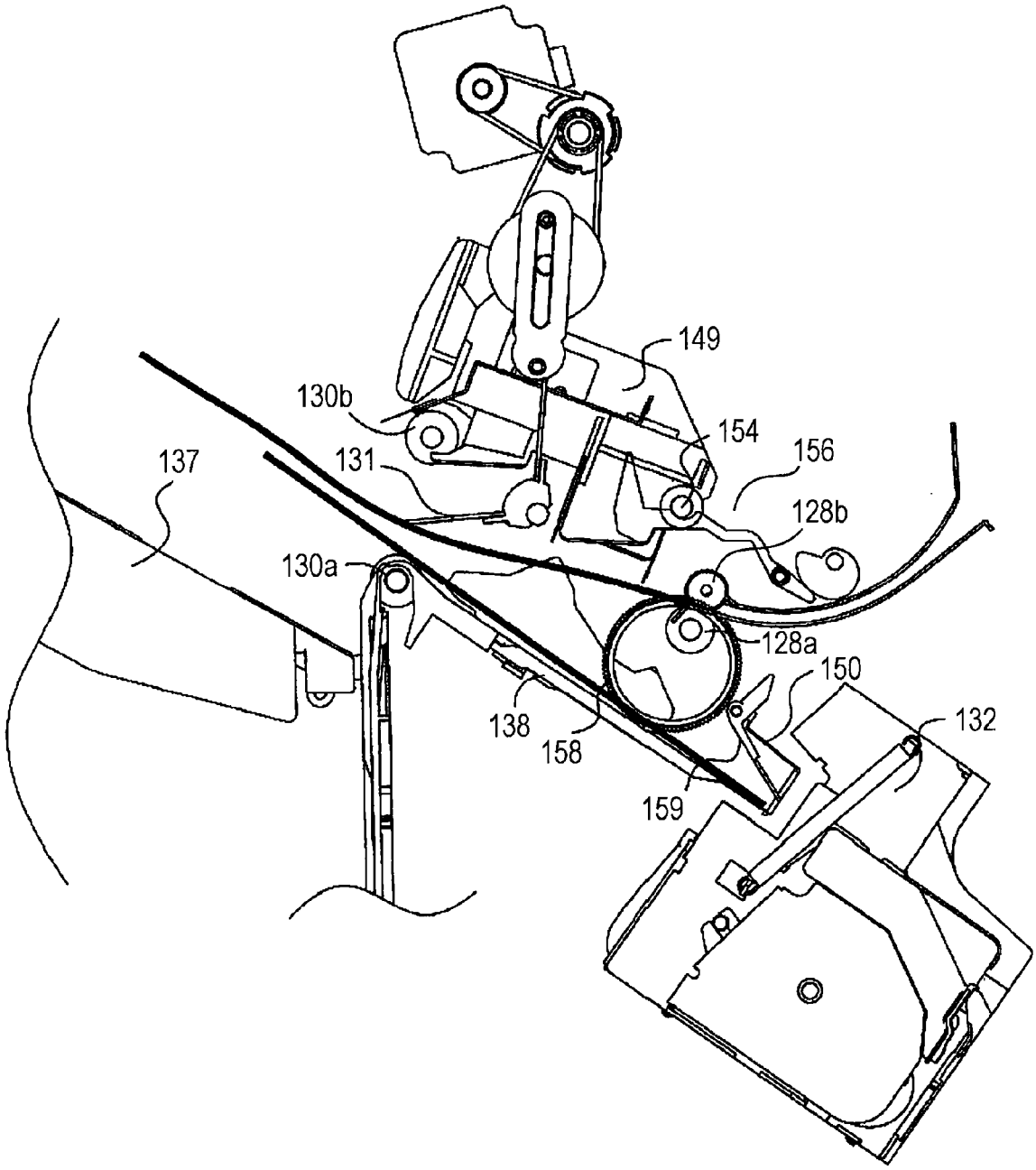
FIG. 12 is a diagram describing the flow of sheets and the operation of the intermediate processing tray in the staple sort mode.

As illustrated in FIG. 12, the sheet end portion of the sheet S12 discharged to the processing tray 138 is conveyed to the trailing end stopper 150 by rotating the pull-in paddles 131 in a direction in which the sheet is moved in a direction opposite to the discharge direction of the pair of lower discharge rollers 128.

The sheet S12 is drawn to the trailing end stopper 150 by the belt roller 158 which rotates in a direction in which the sheet is moved in a direction opposite to the discharge direction. Then, the sheet S12 is abutted against the surface of the trailing end stopper 150 and aligned. When the alignment of the end portion (trailing end) in the conveying direction of the sheet S12 is completed, the alignment in the width direction is then carried out by the pair of aligning members 340 and 341 in the same manner as that of the first page. A sequence of the operations is repeated until a final sheet S1*n* of the first bundle abuts against the trailing end stopper 150.

Figure 13:
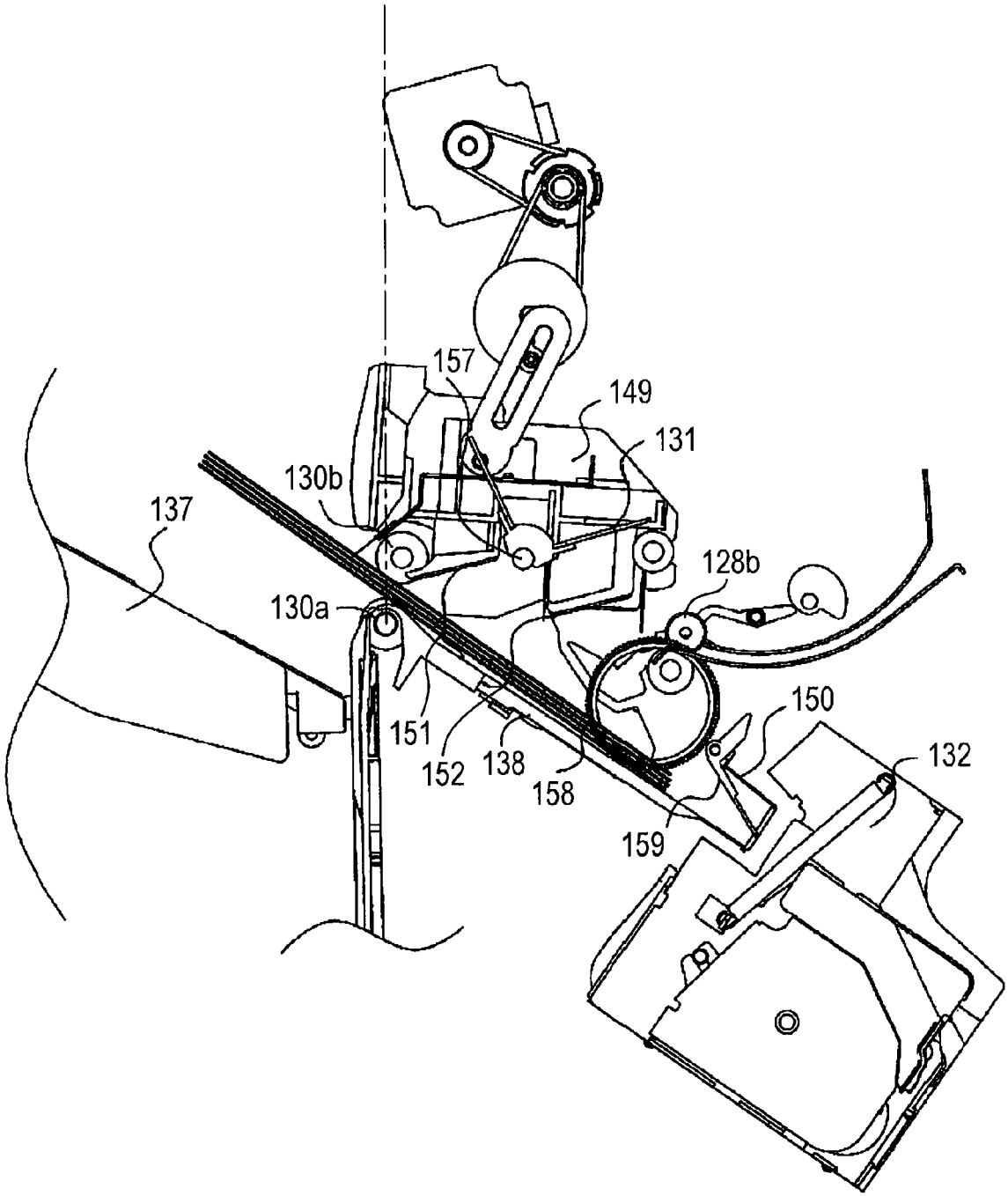
FIG. 13 is a diagram describing the flow of sheets and the operation of the intermediate processing tray in the staple sort mode.
Figure 14:
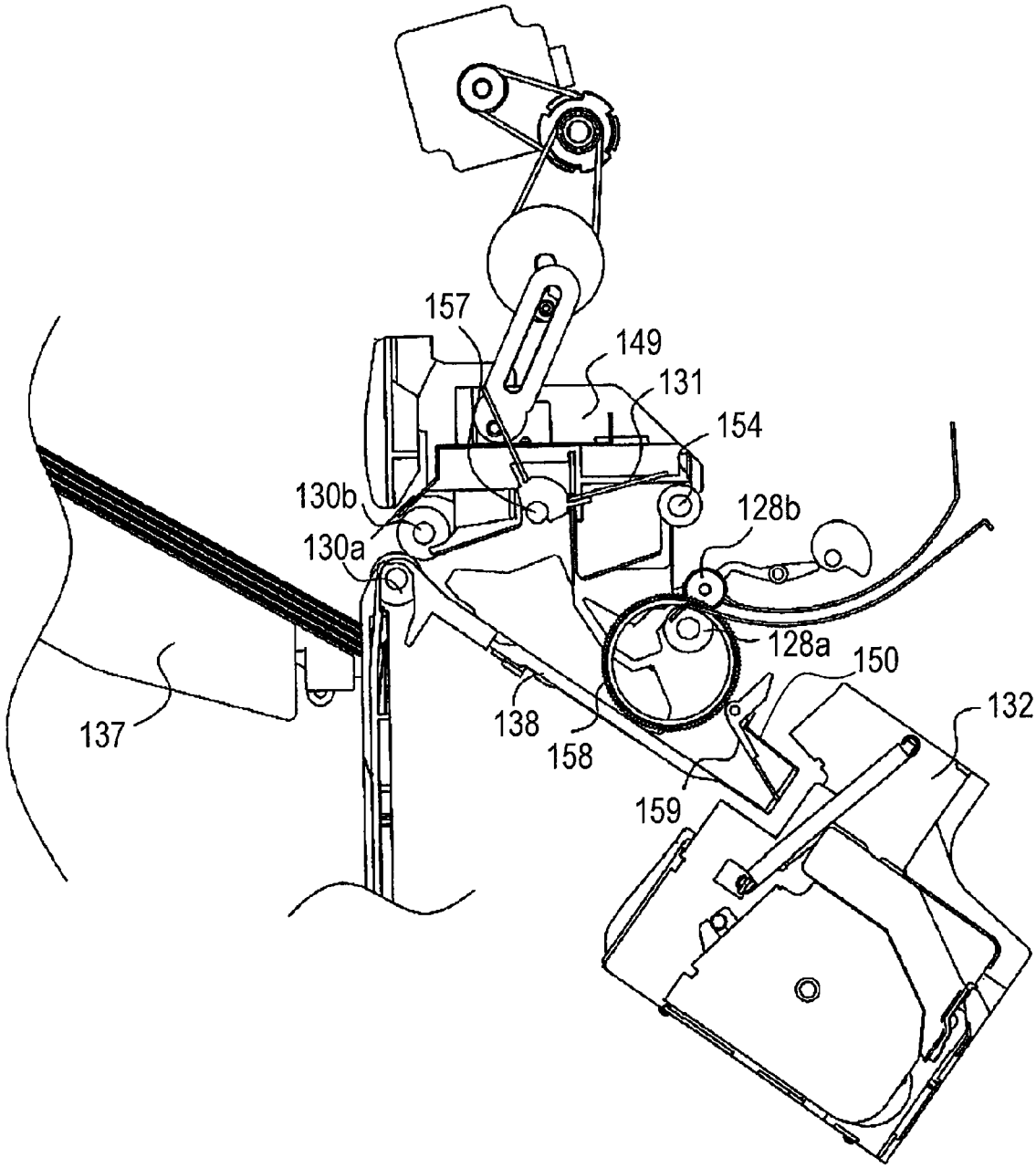
FIG. 14 is a diagram describing the flow of sheets and the operation of the intermediate processing tray in the staple sort mode.

When the aligning operation of the final sheet S1*n* is completed, the trailing end edge of a sheet bundle S1T is clinched by the stapler 132. As illustrated in FIG. 13, the swing guide 149 is moved downwardly and the sheet bundle S1T is nipped by the pair of discharge rollers 130, which is discharged to the lower discharge tray 137 (FIG. 14).

The operation which staples the sheet bundle after the final sheet S1*n* is abutted against the trailing end stopper 150 and the operation which discharges the sheet bundle to the lower discharge tray 137 require extra time as compared to a normal sheet processing operation. During this period, it is difficult to discharge a sheet S21 which is the first page of the second bundle to the processing tray 138.

As described above, in the sheet processing apparatus according to the embodiment, the sheet discharged from the image forming apparatus body 600 is subjected to buffering processing during this period. Thus, a process which does not discharge the sheet to the processing tray 138 is performed while a head sheet of the next bundle is sequentially received from the image forming apparatus body 600.

Figure 15:
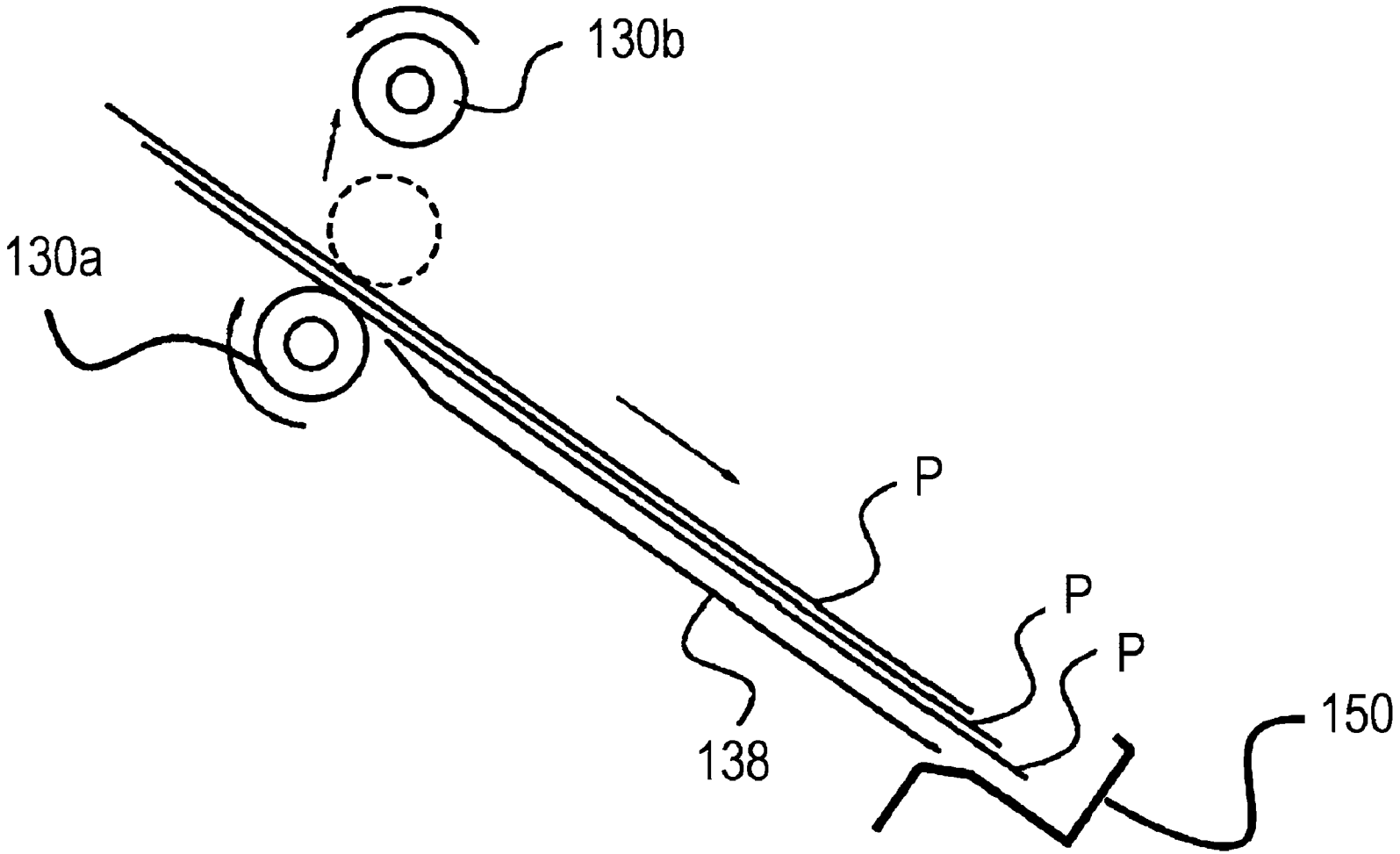
FIG. 15 is an operating diagram describing alignment of buffering sheets.

As illustrated in FIG. 15, the three sheets S21, S22, and S23 of the second bundle which have been subjected to buffering processing during a period until the first sheet bundle is discharged to the lower discharge tray 137 are imbricated (in a state that the sheets are stacked by gradually shifting). The bundle of the sheets S21 to S23 subjected to buffering processing is conveyed from the pair of lower discharge rollers 128 to the pair of discharge rollers 130. As for the sheet bundle made of the three sheets, the trailing end is passed through the pair of lower discharge rollers 128 and then a predetermined amount of the sheets is conveyed by the pair of discharge rollers 130. Thereafter, the pair of discharge rollers 130 is rotated in the opposite direction in the same manner as that of the first page of the first bundle and the sheet is conveyed in a direction opposite to the discharge direction of the pair of discharge rollers 130 at the conveying speed Vb so that the trailing end of the sheet bundle is abutted against the trailing end stopper 150.

The swing guide 149 is raised before the trailing end of the sheet bundle is abutted against the trailing end stopper 150, and the upper discharge roller 130*b* is spaced from the lower discharge roller 130*a*. In the sheet processing operation from the fourth page to the final page of the second bundle, the aligning process is performed in the same manner as that of the first bundle, and the sheet is discharged to the lower discharge tray 137 after the staple process. After repeating the operation of the specified number of copies, the job is finished.

(Operational Control of Pull-In Paddles 131)

Subsequently, the operational control of the pull-in paddles 131 will be described. As described above, the pull-in paddles 131 rotate in a direction in which the sheet is moved in a direction opposite to the discharge direction of the pair of lower discharge rollers 128 in order to abut the trailing end of the sheet discharged from the pair of lower discharge rollers 128 against the trailing end stopper 150 to align. With reference to the number of rotation of the pull-in paddles 131 according to the embodiment, the pull-in paddles 131 make one rotation for every sheet to be discharged in the case of small sizes, such as B5, A4, and LTR. In the case of large sizes, such as A3, B4, and LDR, the pull-in paddles 131 make two rotations for every sheet to be discharged.

Although this is due to the sheet discharge interval for each size of the sheets to be discharged, it largely depends on the difference of the inertial force by the mass of the sheet.

For example, in the case of the small size sheet with a small mass, the inertial force is small and thus the braking action of the sheet and the return conveying action can be given to the sheet by giving the paddle one rotation. It is not necessary to give the paddle one rotation or more.

On the other hand, in the case of the large size sheet with a large mass, the inertial force is large and thus only the braking action of the sheet can be given to the sheet by one rotation of the paddle. Accordingly, the sheet cannot be abutted against the side of the trailing end stopper 150. Therefore, the pull-in paddles 131 are rotated two rotations. The first rotation gives the braking action of the sheet and the second rotation gives the return conveying action of the sheet.

In this regard, the rotation number of the drive shaft 157 is not limited to the above-described number of rotation. Any number of rotations may be used as long as the sheet can be abutted against the trailing end stopper 150 by giving the drive shaft 157 more than one rotation according to the mass of the sheet.

Figure 16:
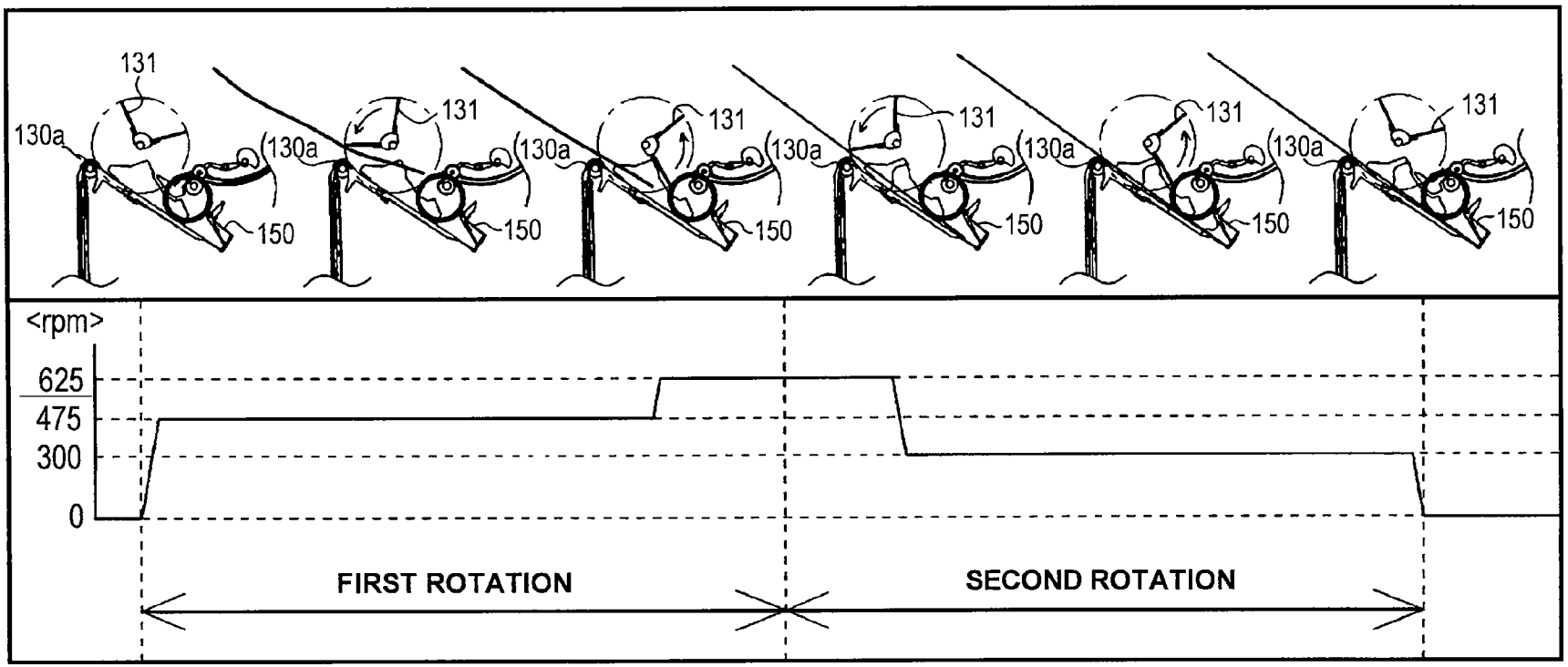
FIG. 16 is a diagram describing the operation of the rotating member according to the embodiment.

FIG. 16 illustrates the rotating speed (rpm) of the pull-in paddles 13l and a relative relationship of the sheet position and the pull-in paddles 131. As illustrated in FIG. 16, when the trailing end of the sheet in the discharge direction is discharged to the processing tray 138, the pull-in paddles 131 start to rotate at a speed (the first rotating speed) of 475 rpm. The pull-in paddles 131 are rotated to the region where the abutment of the pull-in paddles 131 rotating one rotation against the sheet is finished at a uniform speed of 475 rpm. At this time, the paddles 131 brake and drop the sheet on the lower discharge tray 137 by applying a force in a direction opposite to the discharge direction to the sheet discharged from the pair of lower discharge rollers 128 from above. Then the paddles 131 change the conveying direction of the discharged sheet to the direction in which the sheet is abutted against the trailing end stopper 150.

When the pull-in paddles 131 enter the region where the pull-in paddles 131 are not a butted against the sheet, the rotating speed is increased to 625 rpm. Thereafter, the rotating speed is decreased to 300 rpm (second rotating speed) which is slower than the first rotating speed just before the pull-in paddles 131 rotating two rotations are again abutted against the sheet. Then, the sheet is conveyed until the trailing end of the sheet is a butted against the trailing end stopper 150. The pull-in paddles 131 are rotated to the position where the pull-in paddles 131 reach the home position, and they are stopped at the home position.

The third rotating speed (625 rpm) when the non-conveying region is rotated and passed through the upper part of the sheet is faster than the first and second rotating speeds (the rotating speed when the conveying region is rotated and passed through the upper part of the sheet).

As described above, in the sheet processing apparatus according to the embodiment, the rotating speed of the pull-in paddles 131 is controlled at three levels. The pull-in paddles 131 are rotated at a medium speed in the first rotation, namely, at the time of the braking action of the sheet. At the time of the return conveying action of the sheet in the second rotation, the pull-in paddles 131 are rotated at a low speed. In a region where the sheet does not come into contact with the pull-in paddles 131, the pull-in paddles 131 are rotated at a high speed. As a result, the pull-in paddles 131 can be rotated two rotations in a short period time without misalignment of the sheet on the processing tray 138 even in a discharge state that the discharge interval of the sheet is short and the productivity is high.

In the embodiment, the pull-in paddles 131 in the second rotation are rotated to the home position (stop position) while a low-speed range (300 rpm) is maintained. However, when the pull-in paddles 131 enter the region where the pull-in paddles 131 are not abutted against the sheet, the rotating speed may be again increased to 625 rpm. Then, the pull-in paddles 131 are rotated to the position where the pull-in paddles 131 reach the home position, and they may be stopped at the home position. This control process enables the rotation time of the paddle to be further reduced. Furthermore, the sheet processing operation between the small size sheets can be made.

(Control Portion)

Figure 17:
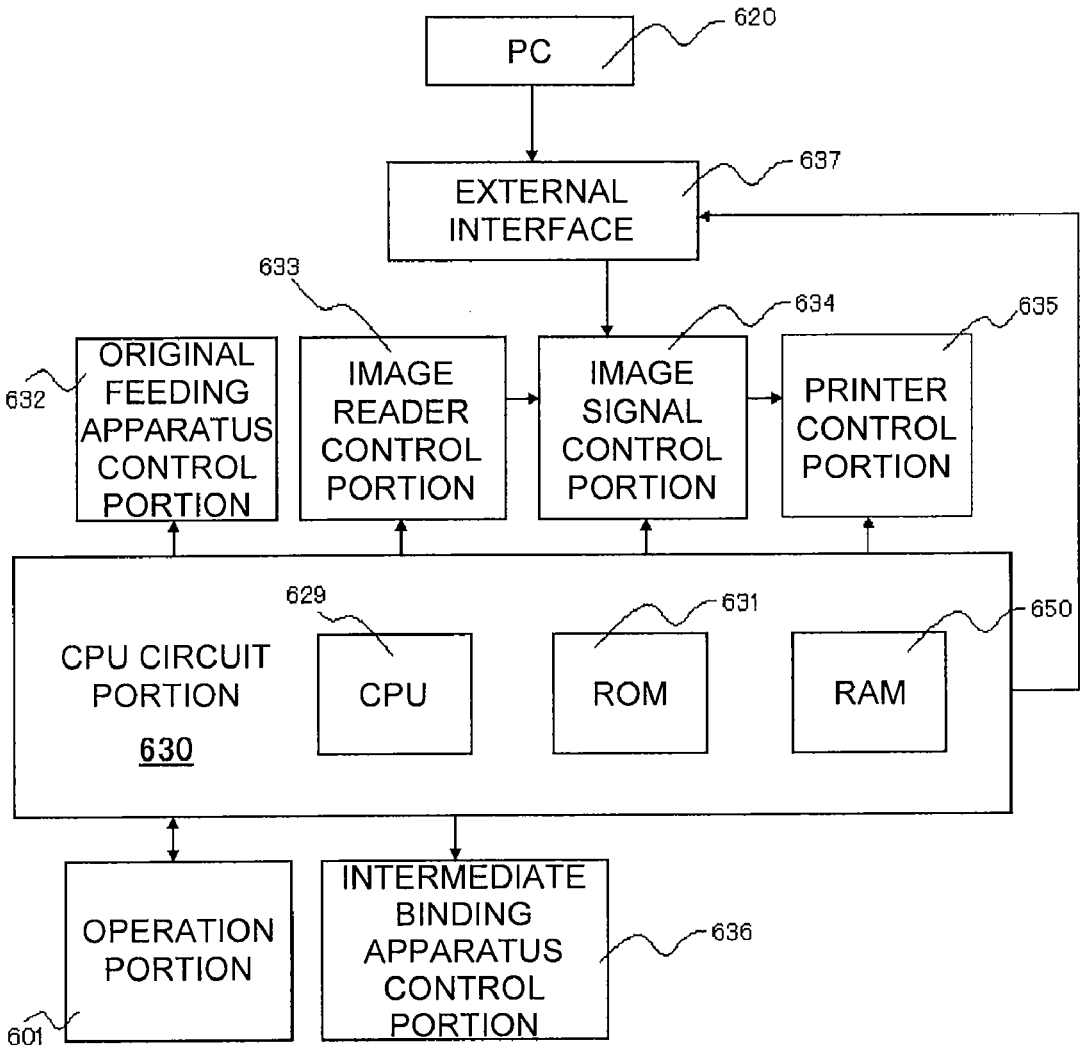
FIG. 17 is a block diagram of the image forming apparatus control portion according to the embodiment.

FIG. 17 is a block diagram of the image forming apparatus control portion which controls the image forming apparatus. As illustrated in FIG. 17, a CPU circuit portion 630 has a CPU 629, a ROM 631, and a RAM 650. The CPU circuit portion 630 controls an original feeding apparatus control portion 632, an image reader control portion 633, an image signal control portion 634, a printer control portion 635, a finisher control portion 636, and an external interface 637. The CPU circuit portion 630 controls according to programs stored in the ROM 631 and settings of the operation portion 601.

The original feeding apparatus control portion 632 controls an original feeding apparatus 750. The image reader control portion 633 controls an image reader. The printer control portion 635 controls the image forming apparatus body 600. The finisher control portion 636 controls the finisher 100. In the embodiment, a structure in which the finisher control portion 636 is mounted in the finisher 100 will be described. However, the present invention is not limited thereto. The CPU circuit portion 630 is integrally provided in the image forming apparatus body 600 so that the finisher 100 is controlled from the side of the image forming apparatus body 600.

The RAM 650 is used as an area for temporarily holding the control data and a working area of a calculation in association with the controlling operation. The external interface 637 is an interface from a computer (PC) 620. The external interface 637 converts the print data into an image data and outputs it to the image signal control portion 634. The image read by the image sensor is output from the image reader control portion 633 to the image signal control portion 634. The image output from the image signal control portion 634 to the printer control portion 635 is input to an exposure controlling portion.

Figure 18:
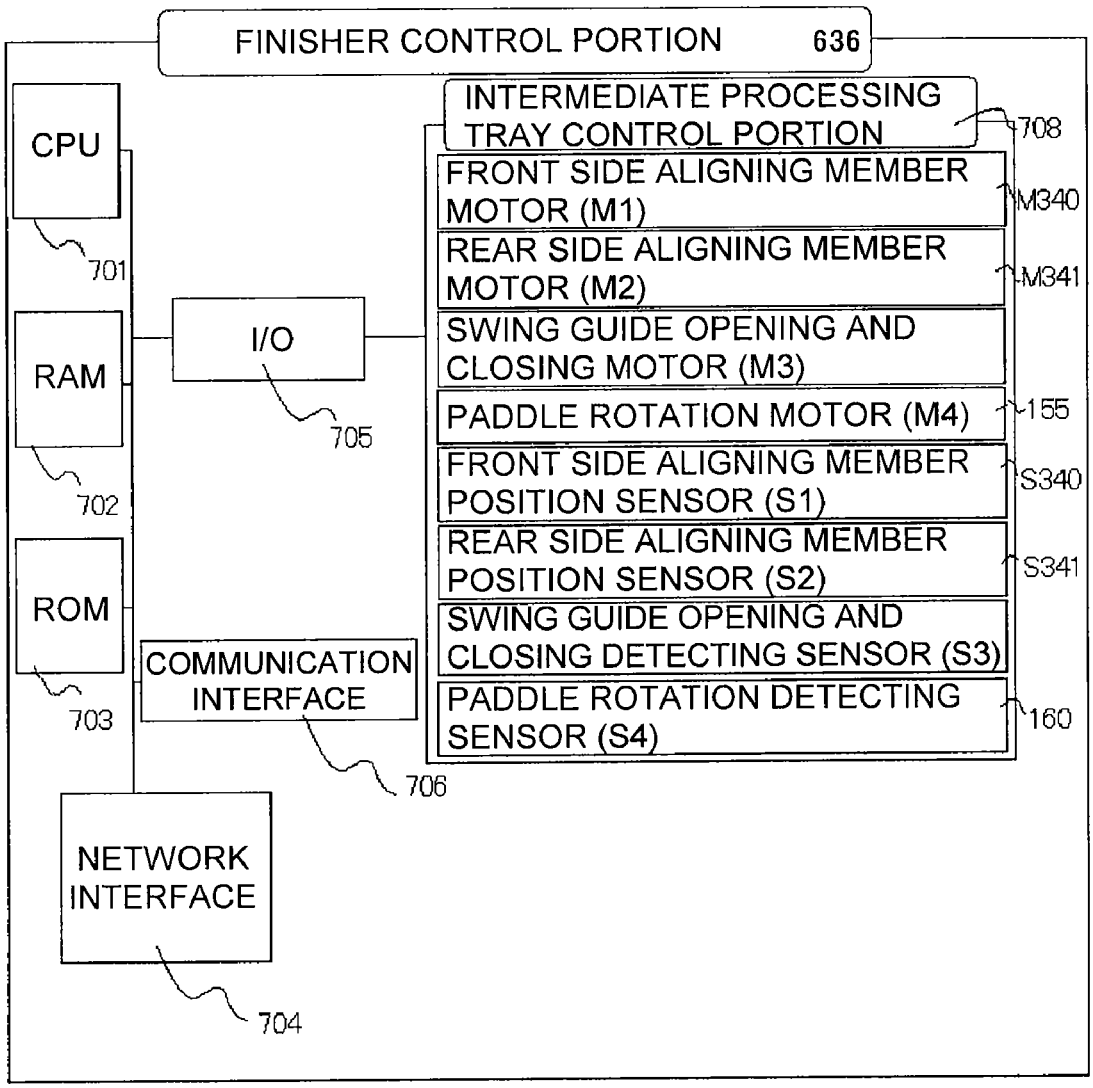
FIG. 18 is a block diagram of a finisher control portion according to the embodiment.

FIG. 18 is a block diagram of the finisher control portion 636 which controls the finisher 100. As illustrated in FIG. 18, the finisher control portion has a microcomputer (CPU) 701, a RAM 702, a ROM 703, an input/output portion (I/O) 705, a communication interface 706, and a network interface 704.

In a conveying control portion (not illustrated), the detecting process of the end in the width direction of the sheet, the sheet buffering process, and the conveying process are carried out. In an intermediate processing tray control portion 708, the operational control of the aligning members, the operational control of the pull-in paddles, and the opening and closing control of the swing guide are controlled by a home position detecting sensor and a movable motor.

Various sensor signals are input to an input port of the I/O 705. Respective driving systems which are connected via a control block (not illustrated) and various drivers (not illustrated) are connected to the output port of the I/O 705.

(Sheet Discharge Control)

Figure 19:
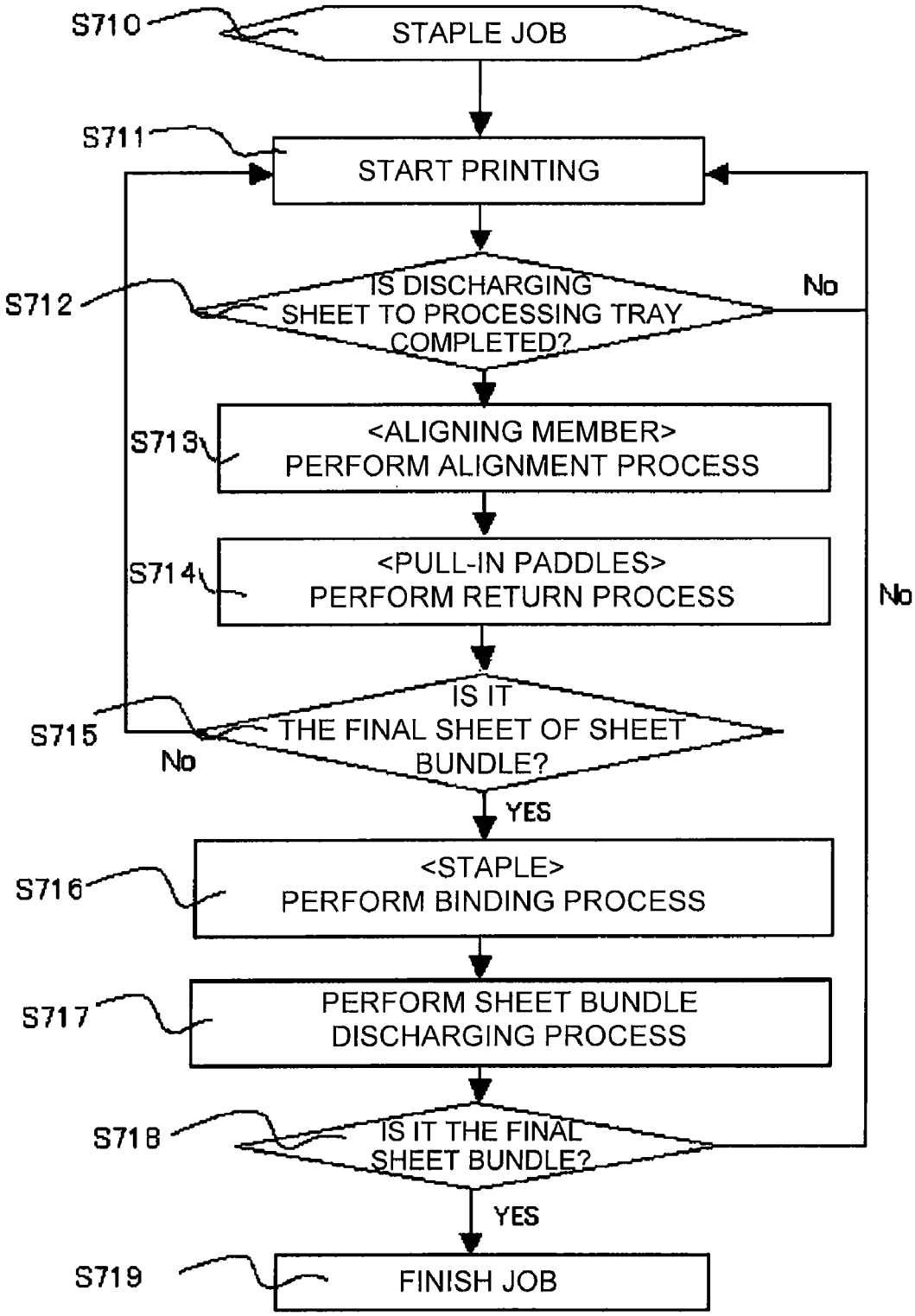
FIG. 19 is a flow chart diagram of the finisher control portion according to the embodiment.

FIG. 19 is a flow chart when the staple job is selected by the operation portion 601 of the image forming apparatus body in the finisher control portion. As illustrated in FIG. 19, when the staple job is selected (S710), printing from the image forming apparatus body 600 is started (S711) and discharging of the sheet to the intermediate processing tray portion of the finisher 100 is started. When the discharging of the sheet to the processing tray is completed (S712), the alignment process is performed by the first and second aligning members 340 and 341 (S713). When the alignment process in the width direction of the sheet is finished, return process is started by the pull-in paddles 131 (S713)

Figure 20:
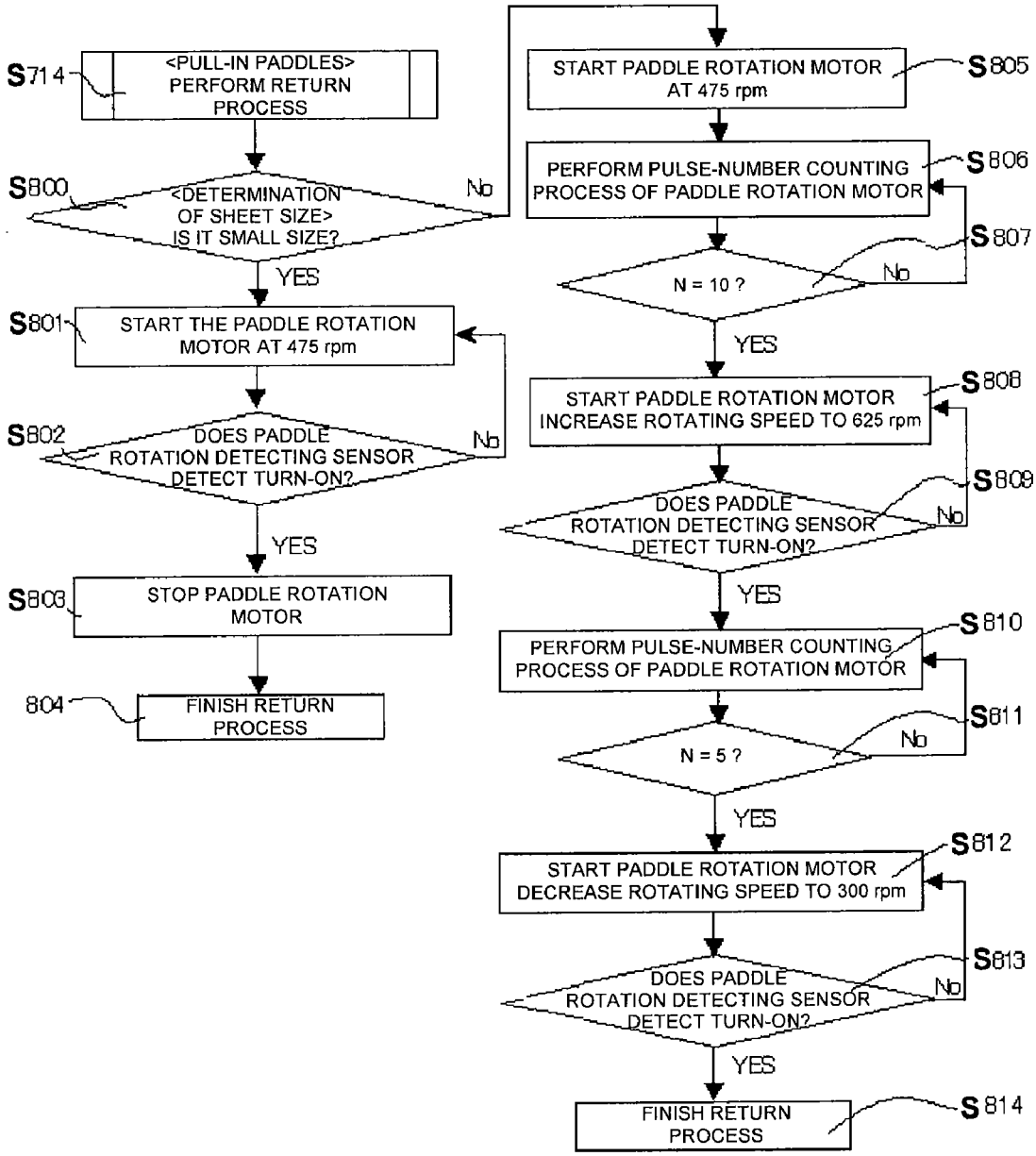
FIG. 20 is a flow chart diagram of the finisher control portion according to the embodiment.

FIG. 20 is a flow chart diagram of the return process of the pull-in paddles 131. In the case where the sheet has a small size in the determination of the size of the sheet (S800), the paddle rotation motor 155 starts running at a rotating speed of 475 rpm (S801). When the drive shaft 157 has finished nearly one rotation, the turn-on of the paddle rotation detecting sensor 160 is detected and determined (S802). When the turn-on of the paddle rotation detecting sensor 160 is detected, the pull-in paddles 131 stop at a home position where one rotation has been made and the return process of the pull-in paddles 131 is finished.

In the case where the sheet has a size other than the small size (e.g. large size etc.) in the determination of the size of the sheet (S800), the paddle rotation motor 155 starts running at a first rotating speed of 475 rpm (S805) and the process is moved to the pulse counting process of the paddle rotation motor 155 (S806). When a pulse count of the paddle rotation motor 155 reaches 10 pulses, namely, when blades of the pull-in paddles 131 reach the position of the non-conveying rotational region σ (FIG. 7) of the first rotation, the rotating speed of the paddle rotation motor 155 is increased to 625 rpm (S807 and S808). When the turn-on of the paddle rotation detecting sensor 160 is detected and determined (S809), the pull-in paddles start the second rotation and the pulse counting process of the paddle rotation motor 155 is again carried out (S810) When a pulse count of the paddle rotation motor 155 reaches 5 pulses, namely, when blades of the pull-in paddles 131 reach the position of the conveying rotational region λ (FIG. 7) of the second rotation, the rotating speed of the paddle rotation motor 155 is decreased to the second rotating speed, i.e., 300 rpm (S811 and S812). When the turn-on of the paddle rotation detecting sensor 160 is detected, the pull-in paddles 131 stop at a home position where two rotations have been performed and the return process of the pull-in paddles 131 is finished (S813 and S814).

When the return process of the pull-in paddles 131 is completed in FIG. 19, the determination of the final sheet of the bundle of sheets (S715) is performed. When the sheet is not the final sheet of the bundle of sheets, the process is again returned to the process (S711). When the sheet is the final sheet of the bundle of sheets, the process is moved to the staple binding process (S716). When the binding process is completed, the sheet bundle discharge process is performed, the sheet bundle which is stapled is then discharged to the lower discharge tray 137 (S717). If the discharged sheet bundle is not the final bundle (S718), the process returns to the process flow of the following bundle (S711). When the discharged sheet bundle is the final bundle, the staple job of the finisher 100 is finished (S719).

In the embodiment, the sheet is abutted against the trailing end stopper 150 by giving the pull-in paddles 131 one or two rotations according to the sheet size. However, it is desirable that the pull-in paddles 131 are rotated three rotations or more and the rotating speed (rotation number) of the conveying rotational region λ (FIG. 7) is gradually decreased for every rotation from the first rotation when the sheet discharge interval is extended or when the thick sheet is processed. Further, if the rotating speed of the non-conveying rotational region σ (FIG. 7) is controlled so as to set it to a speed equal to or more than the rotating speed of the first rotation, the sheet discharge interval can be set to a short interval.

Further, in the embodiment, although the rotating speed of the pull-in paddles 131 is changed for every rotation, for example, the number of the pull-in paddles 131 to be operated may be changed for every rotation. At this time, it is preferable that the number of the pull-in paddles 131 to be operated is gradually reduced from the first rotation. In an alternative method, an operating pressure when the pull-in paddles 131 come into contact with the sheet may be changed for every rotation. At this time, it is preferable that the operating pressure is gradually reduced for every rotation from the first rotation. A distance between the drive shaft 157 and the processing tray 138 is set to be variable and the drive shaft 157 is gradually raised to keep the drive shaft 157 away from the processing tray 138.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-047827, filed Feb. 28, 2008, No. 2009-030794, filed Feb. 13, 2009 which are hereby incorporated by reference herein in their entirety.

What is claimed is:

1. A sheet stacking apparatus comprising:

a sheet discharging portion which discharges a sheet;

a stacking portion which stacks the sheet discharged from the sheet discharging portion;

a regulating portion which aligns an end portion in a discharge direction of a sheet bundle stacked on the stacking portion; and a rotating member which drops the sheet discharged from the sheet discharging portion on the stacking portion by applying a force to the discharged sheet from above and conveys the sheet in a direction opposite to the discharge direction of the sheet discharging portion to abut against the regulating portion;

wherein the rotating member rotates at a first rotating speed so that the sheet discharged from the sheet discharging portion is dropped on the stacking portion and the rotating member rotates at a second rotating speed, slower than the first rotating speed, so that the sheet abuts against the regulating portion.

2. The sheet stacking apparatus according to claim 1, wherein the rotating member has a blade provided on a shaft and the sheet is braked by rotating the blade.

3. The sheet stacking apparatus according to claim 1, wherein the rotating member has a blade provided on a shaft and the sheet is abutted against the regulating portion by rotating the blade.

4. The sheet stacking apparatus according to claim 1, wherein the rotating member has a blade provided on a shaft and the blade comes into contact with the sheet intermittently by rotating the blade.

5. The sheet stacking apparatus according to claim 4, wherein the rotating member has a plurality of blades provided on the shaft.

6. The sheet stacking apparatus according to claim 5, wherein the rotating member has a conveying region with the blade and a non-conveying region without the blade with respect to the shaft, and wherein the rotating member rotates at the first and the second rotating speed when the conveying region is passed through the upper part of the sheet and the rotating member rotates at a third rotating speed when the non-conveying region is passed through the upper part of the sheet, and the third rotating speed is faster than the first and second rotating speed.

7. A sheet processing apparatus comprising:

a sheet stacking apparatus according to claim 1; and a sheet processing unit which processes the sheet stacked on the sheet stacking apparatus.

8. An image forming apparatus comprising:

an image forming portion which forms an image on a sheet; and a sheet processing apparatus according to claim 1.

9. The image forming apparatus according to claim 8, wherein the sheet processing apparatus is connected to an outlet which discharges the sheet having the image formed thereon.

10. An image forming apparatus comprising:

an image forming portion which forms an image on a sheet; and a sheet stacking apparatus which stacks the sheet having the image formed thereon;

the sheet stacking apparatus including:

a sheet discharging portion which discharges a sheet;

a stacking portion which stacks the sheet discharged from the sheet discharging portion;

a regulating portion which aligns an end portion in a discharge direction of a sheet bundle stacked on the stacking portion; and a rotating member which drops the sheet discharged from the sheet discharging portion on the stacking portion by applying a force to the discharged sheet from above and conveys the sheet in a direction opposite to the discharge direction of the sheet discharging portion to abut against the regulating portion;

wherein the abutment member rotates at a first rotating speed so that the sheet discharged from the sheet discharging portion is dropped on the stacking portion and the rotating member rotates at a second rotating speed, slower than the first rotating speed, so that the sheet abuts against the regulating portion.

11. The image forming apparatus according to claim 10, wherein the rotating member has a blade provided on a shaft and the sheet is braked by rotating the blade.

12. The image forming apparatus according to claim 10, wherein the rotating member has a blade provided on a shaft and the sheet is abutted against the regulating portion by rotating the blade.

13. The image forming apparatus according to claim 10, wherein the rotating member has a blade provided on a shaft and the blade comes into contact with the sheet intermittently by rotating the blade.

14. The image forming apparatus according to claim 13, wherein the rotating member has a plurality of blades provided on the shaft.

15. The image forming apparatus according to claim 14, wherein the rotating member has a conveying region with the blade and a non-conveying region without the blade with respect to the shaft, and wherein the rotating member rotates at the first and second rotating speed when the conveying region is passed through the upper part of the sheet and the rotating member rotates at a third rotating speed when the non-conveying region is passed through the upper part of the sheet, and the third rotating speed is faster than the first and second rotating speed.

* * * * *